US008391757B2

(12) United States Patent
Mizushima et al.

(10) Patent No.: US 8,391,757 B2
(45) Date of Patent: Mar. 5, 2013

(54) IMAGE FORMING APPARATUS AND IMAGE FORMING METHOD

(75) Inventors: Nobuyuki Mizushima, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 297 days.

(21) Appl. No.: 12/839,958

(22) Filed: Jul. 20, 2010

(65) Prior Publication Data

US 2011/0026980 A1 Feb. 3, 2011

(30) Foreign Application Priority Data

Aug. 3, 2009 (JP) ..... 2009-180367

(51) Int. Cl.
*G03G 15/01* (2006.01)

(52) U.S. Cl. ..... 399/301

(58) Field of Classification Search ..... 399/237–240, 399/297–302, 308
See application file for complete search history.

(56) References Cited

U.S. PATENT DOCUMENTS 6,141,026 A * 10/2000 Domoto et al. ..... 347/140
7,630,671 B2 * 12/2009 Aruga et al. ..... 399/237
8,059,978 B2 * 11/2011 Mizushima et al. ..... 399/45

FOREIGN PATENT DOCUMENTS

JP 8-101554 A 4/1996
JP 2000-238400 A 9/2000
JP 2009-157327 A 7/2009

* cited by examiner

*Primary Examiner* — Hoan Tran
(74) *Attorney, Agent, or Firm* — Global IP Counselors, LLP

(57) ABSTRACT

An image forming method includes forming an image on a latent image bearing member by developing a latent image formed on the latent image bearing member using a liquid developing agent having toner and a carrier liquid, transferring the image onto an image bearing belt that cyclically moves while forming a winding portion by being wound upon the latent image bearing member, detecting positions of the image bearing belt using a first sensor and a second sensor disposed in a different position from that of the first sensor, and adjusting a formation position of the latent image based on the results of the detection, wherein at the winding portion, the transfer member makes contact with the latent image bearing member through the image bearing belt, and a transfer bias of a constant voltage is applied to the transfer member.

4 Claims, 14 Drawing Sheets

EXPOSURE TIMING WHEN PRINTING FIRST AND SECOND PAGES

EXPOSURE TIMING WHEN PRINTING THIRD PAGE

XIVA-2
XIVB-2
D4
W41
Wnp
NP
A32
4
31
32
35
36
41
42
43
44
46
47
421
422
422a
423
441
442
471
472
322

IMAGE FORMING APPARATUS AND IMAGE FORMING METHOD

BACKGROUND

1. Technical Field

The present invention relates to what are known as liquid developer-type image forming apparatuses and image forming methods that form an image by developing a latent image using a liquid developing agent having toner and a carrier liquid and transferring that image onto an image bearing belt.

2. Related Art

With this type of image forming apparatus, an endless intermediate transfer belt (this corresponds to an "image bearing belt" according to the invention) that moves cyclically in a predetermined direction is provided, and yellow, magenta, cyan, and black image formation units are provided along the intermediate transfer belt corresponding to each of four mutually different primary transfer locations, as described in, for example, JP-A-2009-157327 (FIG. 1). At each image formation unit, a latent image is formed upon an image bearing member, and the latent image is developed using a liquid developing agent containing a carrier and toner particles, thus forming an image. A color image is then formed by superimposing these images upon the intermediate transfer belt. Accordingly, with this type of image forming apparatus, it is extremely important, from the standpoint of improving the image quality, for each single-color image to be superimposed according to a predetermined positional relationship. In other words, suppressing registration shift is necessary in order to achieve superior image quality.

Here, temperature changes within the apparatus act as a cause of the occurrence of registration shift. In other words, there are situations where, if the temperature within the apparatus changes, the intermediate transfer belt expands/contracts, or roller diameters change and cause fluctuations in belt speeds, in accordance with the temperature change. As a result, there have been situations where the images of each color transferred onto the intermediate transfer belt have shifted relative to each other, which in turn leads to a drop in the image quality.

Accordingly, applying a technique such as that disclosed in, for example, JP-A-8-101554, can be considered. That is, with the apparatus disclosed in JP-A-8-101554 (FIG. 9), two sensors are arranged in the movement direction of an endless belt, and the times at which an opening hole provided in the endless belt passes the two sensors are detected thereby. The belt speed is also found based on the result of that detection, and the formation timing of the latent image is controlled in correspondence therewith. Accordingly, when this technical spirit is applied to the so-called liquid developer-type image forming apparatus disclosed in JP-A-2009-157327, the relative positions of the latent images are adjusted even if the belt speed fluctuates, thus correcting registration shift.

Incidentally, a liquid developing agent in which toner particles are dispersed throughout a carrier liquid is used in such liquid developer-type image forming apparatuses, and therefore, as has been generally known thus far, there is a trend for the transfer efficiency thereof to be less than so-called dry-type image forming apparatuses. Accordingly, forming winding portions by winding the intermediate transfer belt upon each of the image bearing members and performing the primary transfer of the images formed upon the image bearing members onto the intermediate transfer belt at those winding portions has been proposed.

However, at each winding portion, the region at which the image bearing member and the intermediate transfer belt make contact with each other is broad, and thus the time variation of the belt resistance value is greater than that with dry-type image forming apparatuses. In other words, the longer the operating time of the apparatus becomes, the greater the variation in the belt resistance values grows. Furthermore, if the intermediate transfer belt is replaced, there is a wide discrepancy between the belt resistance values prior to and following the replacement. There are thus situations in which the voltages at the primary transfer locations fluctuate greatly. In addition, because this region is broad, there have been situations in which the voltages at the primary transfer locations have been affected even with different image patterns.

With such a liquid developer-type image forming apparatus that has winding portions, fluctuations in the voltages occur with ease at the primary transfer locations, and as will be described later with reference to FIG. 5, friction arising between the image bearing members and the intermediate transfer belt at the primary transfer locations changes due to the stated fluctuations in the voltages. As a result, even if the belt speed is accurately measured using the technique disclosed in JP-A-8-101554, the belt speed will fluctuate due to the fluctuation in the friction, and thus is it difficult to carry out accurate registration adjustment.

SUMMARY

An advantage of some aspects of the invention is, in a liquid developer-type image forming apparatus having a winding portion and an image forming method, to suppress fluctuations in the friction at a winding portion and stabilize the speed of a belt.

An image forming apparatus according to an embodiment of the invention includes: a latent image bearing member that forms a latent image; a developing unit that forms an image upon the latent image bearing member by developing the latent image formed upon the latent image bearing member using a liquid developing agent having toner and a carrier liquid; an image bearing belt that moves cyclically while forming a winding portion by being wound upon the latent image bearing member, and onto which the image developed by the developing unit is transferred; a transfer member that makes contact with the latent image bearing member through the image bearing belt at the winding portion and that transfers the image developed upon the latent image bearing member onto the image bearing belt; a transfer bias application unit that applies a transfer bias of a constant voltage to the transfer member; a first sensor that detects a position of the image bearing belt; and a second sensor, disposed in a different position from that of the first sensor, that detects a position of the image bearing belt.

Here, multiple latent image bearing members may be provided with respect to an image bearing belt. For example, there is an image forming apparatus that includes: a first latent image bearing member that forms a latent image; a first developing unit that forms an image upon the first latent image bearing member by developing the latent image formed upon the first latent image bearing member using a liquid developing agent having toner and a carrier liquid; a second latent image bearing member, disposed in a different position from that of the first latent image bearing member, that forms a latent image; a second developing unit that forms an image upon the second latent image bearing member by developing the latent image formed upon the second latent image bearing member using the liquid developing agent; and an image bearing belt that moves cyclically while forming a first winding portion by being wound upon the first latent image bearing member and a second winding portion by being wound upon the second latent image bearing member, and onto which the image developed by the first developing unit and the image developed by the second developing unit are transferred. An image forming apparatus according to another aspect of the invention may employ such an image forming apparatus that is further configured to include: a first transfer member that makes contact with the first latent image bearing member through the image bearing belt at the first winding portion and that transfers the image developed upon the first latent image bearing member onto the image bearing belt; a second transfer member that makes contact with the second latent image bearing member through the image bearing belt at the second winding portion and that transfers the image developed upon the second latent image bearing member onto the image bearing belt; and a transfer bias application unit that applies a transfer bias of a constant voltage to the first transfer member and the second transfer member.

Meanwhile, an image forming method according to another aspect of the invention includes forming an image upon a latent image bearing member by developing a latent image formed upon the latent image bearing member using a liquid developing agent having toner and a carrier liquid, transferring the image onto an image bearing belt that cyclically moves while forming a winding portion by being wound upon the latent image bearing member, and detecting positions of the image bearing belt using a first sensor and a second sensor disposed in a different position from that of the first sensor and adjusting a formation position of the latent image based on the results of the detection; here, at the winding portion, the transfer member makes contact with the latent image bearing member through the image bearing belt, and a transfer bias of a constant voltage is applied to the transfer member.

According to the invention (the image forming apparatus and the image forming method) configured in this manner, a winding portion is formed by winding the image bearing belt upon the latent image bearing member. At this winding portion, the transfer member makes contact with the latent image bearing member through the image bearing belt, and a transfer bias of a constant voltage is applied to the transfer member. Accordingly, voltage fluctuation at the transfer location (the winding portion) is suppressed even if the belt resistance value of the image bearing belt fluctuates, the patterns of the images transferred onto the image bearing belt from the latent image bearing member differ, or the like; as a result, fluctuations in the friction at the transfer location are suppressed, thus stabilizing the belt speed.

BRIEF DESCRIPTION OF THE DRAWINGS

The invention will be described with reference to the accompanying drawings, wherein like numbers reference like elements.

FIGS. 14A-1, 14A-2, 14B-1 and 14B-2 are diagrams illustrating a relationship between a secondary transfer roller, an intermediate transfer belt, and a driving roller.

DESCRIPTION OF EXEMPLARY EMBODIMENTS

Figure 1:
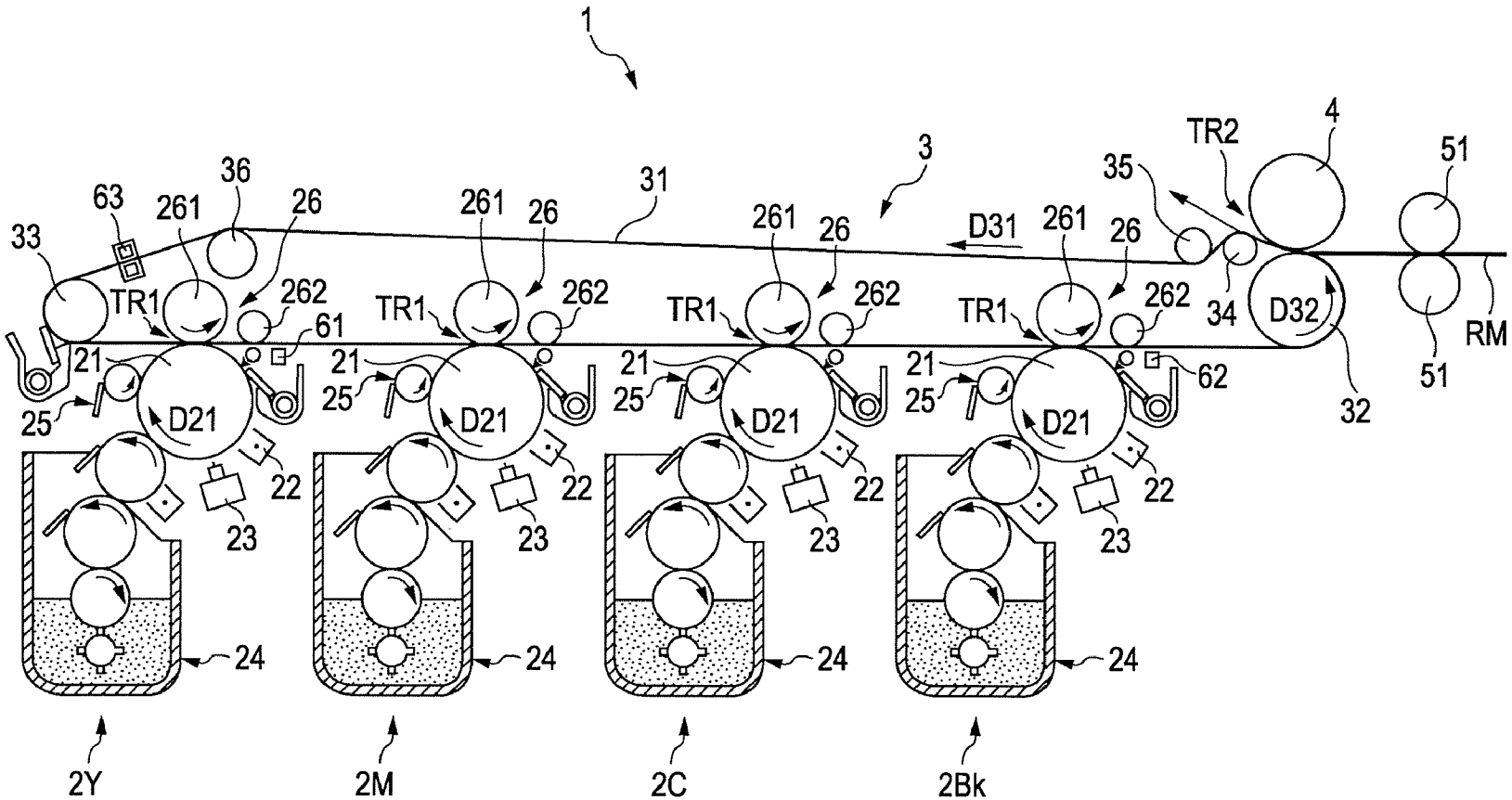
FIG. 1 is a diagram illustrating the overall configuration of a first embodiment of an image forming apparatus according to the invention.
Figure 2:
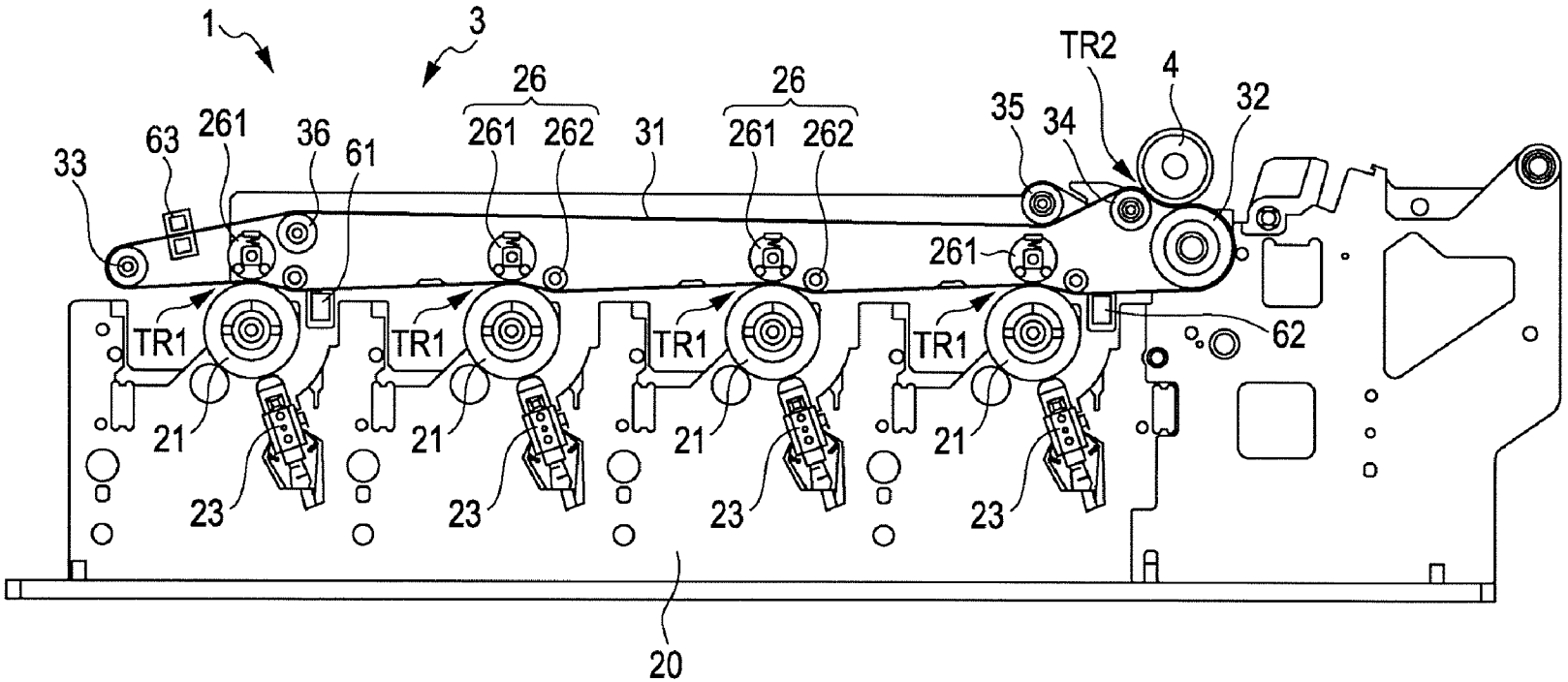
FIG. 2 is a side view of the image forming apparatus illustrated in FIG. 1.
Figure 3:
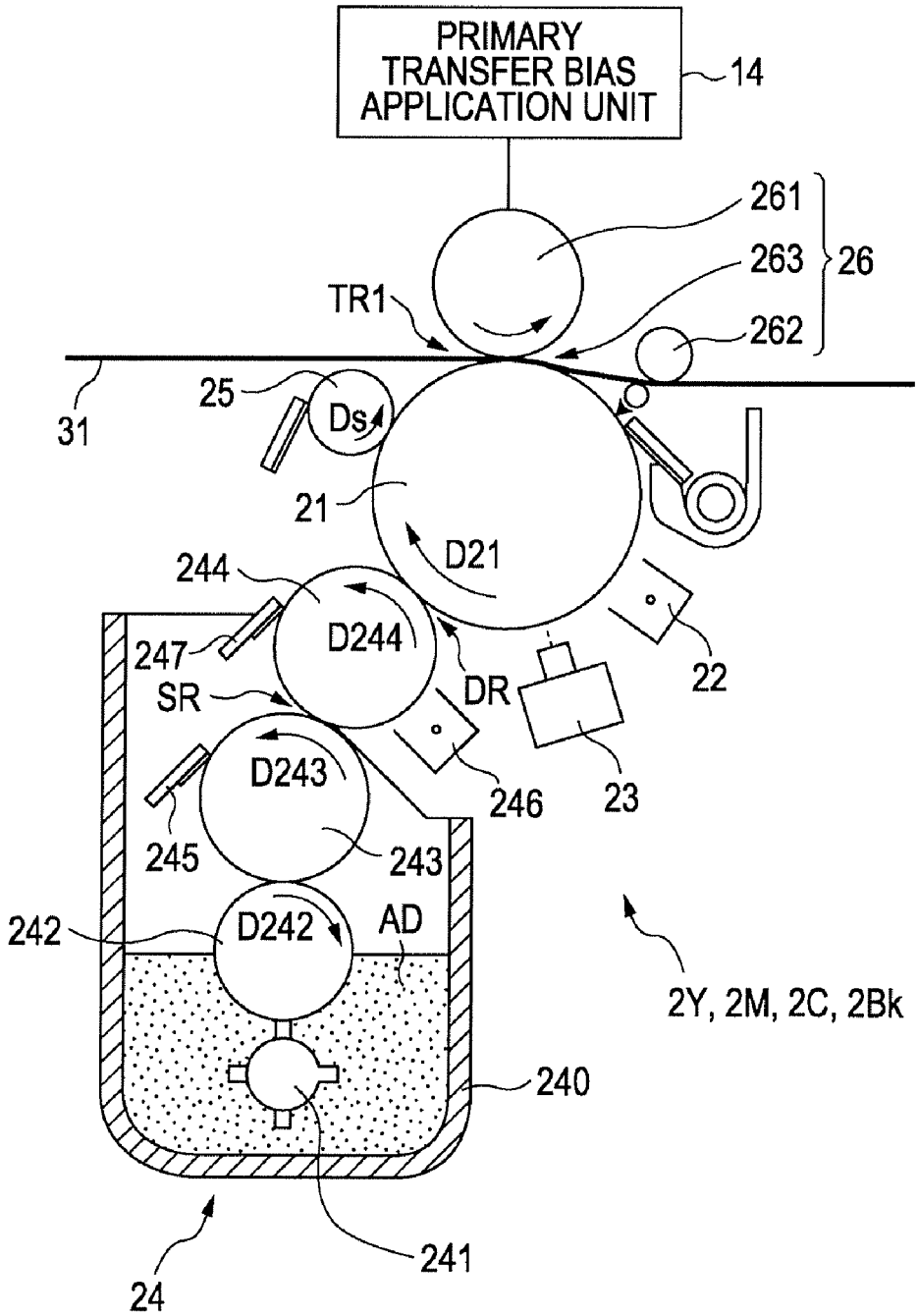
FIG. 3 is a diagram illustrating the configuration of an image forming station.
Figure 4:
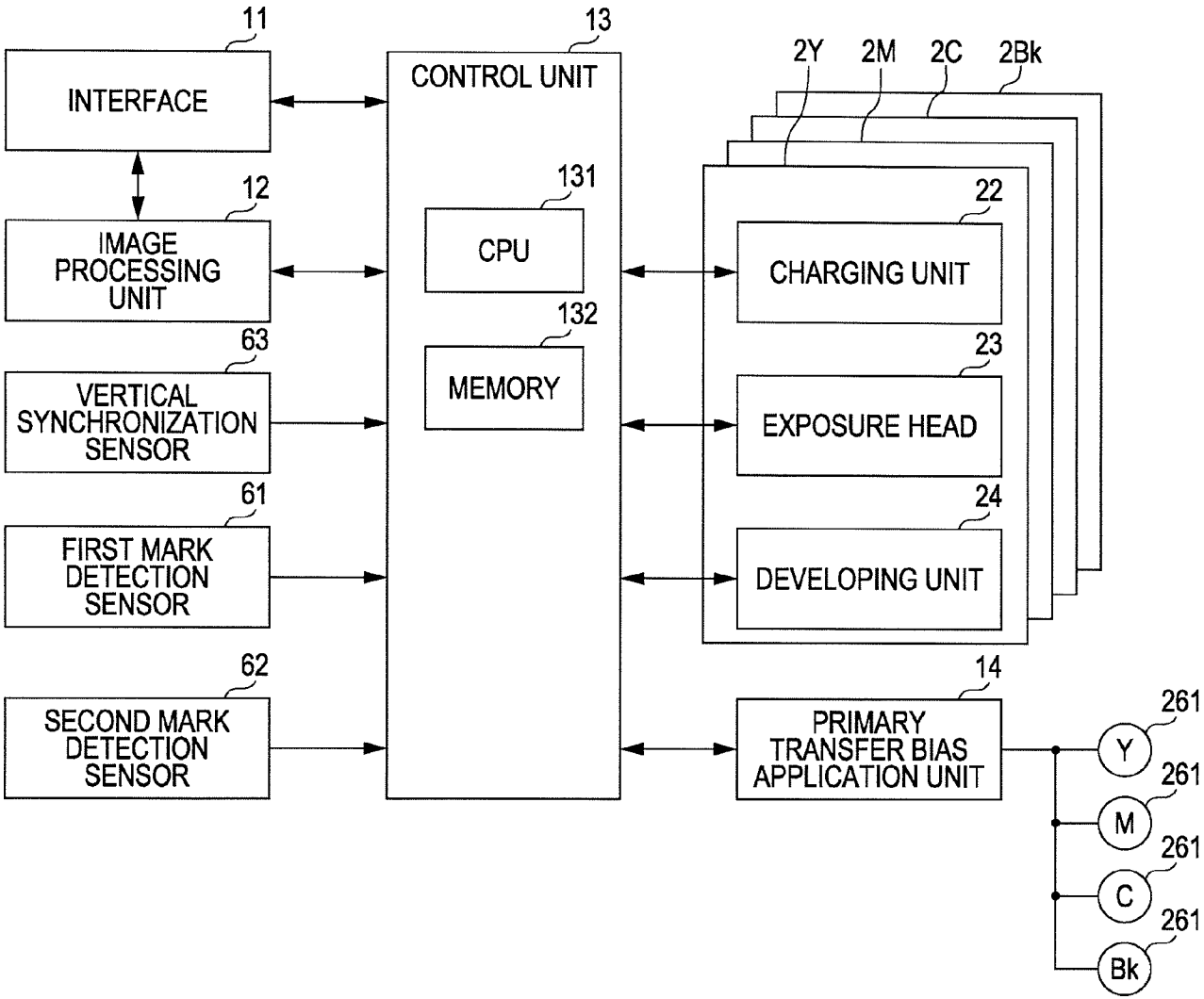
FIG. 4 is a block diagram illustrating the primary electrical configuration of the image forming apparatus illustrated in FIG. 1.

FIG. 1 is a diagram illustrating the overall configuration of a first embodiment of an image forming apparatus according to the invention. Meanwhile, FIG. 2 is a side view of the image forming apparatus illustrated in FIG. 1. FIG. 3 is a diagram illustrating the configuration of an image forming station. FIG. 4, meanwhile, is a block diagram illustrating the primary electrical configuration of the image forming apparatus illustrated in FIG. 1. Of these diagrams, FIG. 2 depicts a state in which an apparatus cover has been removed, in order to facilitate understanding of the positional relationship of photosensitive drums, exposure heads, and mark detection sensors relative to a main body frame.

An image forming apparatus 1 includes four image forming stations, or 2Y (for yellow), 2M (for magenta), 2C (for cyan), and 2Bk (for black), that form images of their respective colors. The image forming apparatus 1 is capable of selectively executing a color mode, in which a color image is formed by superimposing yellow (Y), magenta (M), cyan (C), and black (Bk) toners upon each other, and a monochromatic mode, in which a monochromatic image is formed using only black (Bk) toner. Upon receiving an image formation instruction from an external device such as a host computer, the image forming apparatus executes a predetermined image formation process by controlling the various elements of the apparatus, and forms an image corresponding to the image formation instruction on a sheet-shaped recording medium RM, such as copy paper, transfer paper, a form, a clear sheet used in OHPs, or the like.

Each image forming station, or 2Y, 2M, 2C, and 2Bk, is provided with a photosensitive drum 21, serving as an example of a latent image bearing member, upon the surface of which a latent image of a toner image of the corresponding color is formed. Each photosensitive drum 21 is disposed so that its rotational axis is parallel or approximately parallel to the main scanning direction (the direction vertical relative to the paper in FIG. 1), and is rotationally driven at a predetermined speed in the direction of the arrow D21 in FIG. 1. Meanwhile, in this embodiment, the four photosensitive drums 21 are supported by a main body frame 20 so as to be parallel to a movement direction D31 of an intermediate transfer belt 31, which will be described later, and are furthermore provided at constant intervals. In other words, if the distance between two adjacent photosensitive drums 21 is taken as a "pitch distance", the distance between the yellow photosensitive drum 21 and the black photosensitive drum 21, which are the farthest away from each other, is three times the pitch distance.

A charging unit 22, which is a corona charging unit that charges the surface of the photosensitive drum 21 to a predetermined potential, an exposure head 23 that forms an electrostatic latent image by exposing the surface of the photosensitive drum 21 based on an image signal, a developing unit 24 that visualizes the electrostatic latent image as a toner image, a squeezing unit 25, a primary transfer unit that performs a primary transfer of the toner image onto the intermediate transfer belt 31 of a transfer unit 3, a cleaning unit that cleans the surface of the photosensitive drum 21 following the transfer, and a cleaning blade are disposed in the periphery of each photosensitive drum 21, in that order in the rotational direction D21 of the photosensitive drum 21 (in FIG. 1, the clockwise direction).

The charging unit 22 does not make contact with the surface of the photosensitive drum 21, and a known corona charging unit used in the past can be employed as the charging unit 22. In the case where a scorotron charging unit is employed as the corona charging unit, a wire current flows through a charge wire of the scorotron charging unit, and a direct-current (DC) grid-charging bias is applied to the grid. The photosensitive drum 21 is charged by the corona discharge emitted by the charging unit 22, and the potential of the surface of the photosensitive drum 21 is set to an approximately uniform potential.

The exposure head 23 is attached to the main body frame 20 so as to oppose the photosensitive drum 21 at a predetermined location. In other words, as shown in FIG. 2, the four exposure heads 23 are attached to the main body frame 20 at the aforementioned pitch distance, and in a state in which their light-emitting surfaces (not shown) are facing the respective photosensitive drums 21. Each exposure head 23 exposes the surface of its corresponding photosensitive drum 21 using a light beam based on an image signal received from the external device, thus forming an electrostatic latent image corresponding to the image signal. In this embodiment, as shown in FIG. 4, when an image signal is received via an interface 11 from an external device such as a host computer that generates the image signal, a predetermined process is performed on the image signal by an image processing unit 12. This image signal is then passed to the exposure heads 23 via a control unit (controller) 13 that has a CPU 131 and a memory 132, and that controls the operations of the apparatus as a whole. The exposure heads 23 irradiate and expose the surfaces of corresponding photosensitive drums 21 based on the image signal, and as a result, the electric loads on the exposed surface regions of the photosensitive drums 21 (exposed portions) are neutralized, resulting in a change to different surface potentials than the unexposed surface regions (unexposed portions). In this manner, electrostatic latent images based on the image signal are formed upon the photosensitive drums 21. Although the exposure heads 23 are configured of line heads in which light-emitting elements are arranged in the main scanning direction in this embodiment, it should be noted that a configuration in which a light beam from a semiconductor laser is caused to scan using a polygon mirror may be employed as well.

The developing units 24 then apply toner to the respective electrostatic latent images formed in this manner, and the electrostatic latent images are developed by the toner as a result. Note that with the developing units 24 of the image forming apparatus 1, the toner development is carried out using a liquid developing agent AD in which toner is dispersed within a carrier liquid at a weight ratio of approximately 20%. In this embodiment, a high-viscosity (approximately 30 to 10,000 mPa·s) liquid developing agent having a toner solid content concentration of approximately 20%, and in which solid particles of a colorant such as a pigment having an average particle diameter of 1 μm are dispersed within a high-concentration and high-viscosity resin that is non-volatile at normal temperatures and added to a liquid carrier such as an organic carrier, silicon oil, mineral oil, or cooking oil along with a dispersant, is used, rather than a volatile liquid developing agent that uses Isopar (an Exxon brand) as its carrier liquid, which is volatile at normal temperatures, has a low concentration (approximately 1-2 wt %), and that has a low viscosity, as has generally been used in the past.

The liquid developing agent AD having such components is, as shown in FIG. 3, held in a developer reservoir 240. In order to ensure a uniform dispersion state of the toner particles within the liquid developing agent AD, an agitation member 241 that agitates the liquid developing agent AD is provided within the developer reservoir 240.

Furthermore, each developing unit 24 includes a lift roller 242. This lift roller 242 is partially immersed in the liquid developing agent AD within the developer reservoir 240, and lifts out liquid developing agent AD by rotating in a rotational direction D242 (the clockwise direction in FIG. 3). The liquid developing agent AD lifted out in this manner is supplied to a developing roller 244 after passing along an intermediate roller 243 (a supply roller).

The intermediate roller 243 is disposed between the lift roller 242 and the developing roller 244, and rotates in a rotational direction D243 (the counterclockwise direction in FIG. 3). Because the rotational direction D243 of the intermediate roller 243 is the opposite direction relative to the rotational direction D242 of the lift roller 242, the surface of the intermediate roller 243 and the surface of the lift roller 242 move in the same direction in the region at which the intermediate roller 243 and the lift roller 242 oppose each other. On the other hand, because the rotational direction D243 of the intermediate roller 243 is the same direction relative to a rotational direction D244 (the counterclockwise direction in FIG. 3) of the developing roller 244, the surface of the intermediate roller 243 and the surface of the developing roller 244 move in opposite directions in the region at which the intermediate roller 243 and the developing roller 244 oppose each other (a supply position SR). The intermediate roller 243 supplies the liquid developing agent AD to the developing roller 244 at the supply position SR. Meanwhile, the liquid developing agent AD that has remained on the intermediate roller 243 after passing through the supply position SR is wiped off by a cleaning plate 245.

The developing roller 244 is configured of a metallic center made of iron or the like whose external circumference is covered by an elastic member such as a urethane resin or the like, and forms a nip portion at a developing position DR where the developing roller 244 makes contact with the photosensitive drum 21. This developing roller 244 rotates in the rotational direction D244, and transports the liquid developing agent AD from the supply position SR to the developing position DR. Meanwhile, a voltage application charging unit 246 is disposed between the supply position SR and the developing position DR. This voltage application charging unit 246 is configured of a corona charging unit, and applies a voltage to the developing roller 244 without making contact with the developing roller 244. Due to the applied voltage, charged toner particles within the liquid developing agent AD held on the developing roller 244 are driven so as to conglomerate on the surface of the developing roller 244. A toner layer having a predetermined layer thickness is thus formed on the surface of the developing roller 244.

Incidentally, the layer thickness of the toner layer formed at this time can be controlled by adjusting the rotational speed of the intermediate roller 243. In other words, changing the rotational speed of the intermediate roller 243 changes the amount of liquid developing agent AD that is supplied to the developing roller 244 per unit time, which in turn changes the amount of toner particles, contained in the liquid developing agent AD, that is supplied per unit time (that is, the amount supplied to the developing roller 244). As a result, the layer thickness of the toner layer formed by the conglomeration of toner particles changes. To summarize, a toner layer having a thick layer thickness can be formed by increasing the rotational speed of the intermediate roller 243, whereas a toner layer having a thin layer thickness can be formed by decreasing the rotational speed of the intermediate roller 243. Note that the adjustment of the speed of the intermediate roller 243 can be executed by the control unit 13.

A developing bias application unit (not shown) is electrically connected to the center of the developing roller 244. When the developing bias application unit applies a developing bias to the center of the developing roller 244, the charged toner moves from the developing roller 244 to the surface of the photosensitive drum 21 at the developing position DR. In this manner, the latent image on the surface of the photosensitive drum 21 is developed, thus forming a toner image. Meanwhile, the liquid developing agent AD that has remained on the developing roller 244 after passing through the developing position DR is wiped off by a cleaning blade 247.

Descriptions will now be resumed from FIGS. 1 and 2. The squeezing unit 25 is disposed downstream from the developing position DR in the rotational direction D21 of the photosensitive drum 21. A squeeze roller is provided in this squeezing unit 25. The squeeze roller makes contact with the surface of the photosensitive drum 21 and removes residual carrier liquid and fog toner from the toner image. Although residual carrier liquid, fog toner, and so on are removed by a single squeezing unit 25 in this embodiment, it should be noted that the number and arrangement of squeezing units is not intended to be limited thereto; for example, an additional squeezing unit may be disposed downstream from the squeezing unit 25 in the rotational direction D21.

The toner image that has passed through the squeezing unit 25 undergoes a primary transfer onto the intermediate transfer belt 31 by the primary transfer unit. The intermediate transfer belt 31 is stretched across a group of belt transport rollers 32 to 36 disposed at distances from each other, and is cyclically rotated in a predetermined direction D31 by roller driving performed by a belt driving motor. To be more specific, of the belt transport rollers 32 to 36, the roller 32 that is on the right side in FIG. 1 is the driving roller, and that driving roller 32 is mechanically connected to the belt driving motor. In addition, in this embodiment, a driver (not shown) is provided for driving the belt driving motor, and the driver outputs a driving signal based on a command pulse provided by the control unit 13 to the belt driving motor, thus performing positional control. Through this, the driving roller (belt transport roller) 32 rotates in the direction D32 indicated by the arrow shown in FIG. 1 at a cyclic speed corresponding to the command pulse, and the surface of the intermediate transfer belt 31 moves cyclically in the predetermined direction D31. Note that the rollers 33 to 36 aside from the driving roller 32 are a first tension roller 33, a second tension roller 34, a third tension roller 35, and a fourth tension roller 36, respectively, and these rollers stretch the intermediate transfer belt 31.

A primary transfer unit 26 includes a backup roller 261 and a winding roller 262. The backup roller 261 is disposed so as to oppose the photosensitive drum 21 with the intermediate transfer belt 31 therebetween at a primary transfer location TR1, and makes contact with the photosensitive drum 21 through the intermediate transfer belt 31. Meanwhile, the winding roller 262 is provided downstream in the belt movement direction D31 from that position of contact and pushes the intermediate transfer belt 31 toward the photosensitive drum 21, thus forming a winding portion 263 downstream from the backup roller 261. Furthermore, a primary transfer bias application unit 14 is electrically connected to the backup roller 261, and applies a primary transfer bias of a constant voltage set in a manner described later, thus transferring the toner image present on the photosensitive drum 21 onto the intermediate transfer belt 31. When the toner images are transferred at the primary transfer units 26 for each of the colors, the toner images of each of the colors upon the photosensitive drums 21 are sequentially superimposed upon the intermediate transfer belt 31, thus forming a full-color toner image. Accordingly, in this embodiment, the intermediate transfer belt 31 configured as described thus far corresponds to an "image bearing belt" according to the invention. In addition, the primary transfer unit 26 and backup roller 261 correspond to a "transfer portion" and a "transfer member", respectively, according to the invention.

Meanwhile, a first mark detection sensor 61 is supported on the main body frame 20 slightly downstream from (that is, in FIGS. 1 and 2, on the right-hand side of) the primary transfer location TR1 for yellow of the primary transfer locations TR1 for the four colors. This mark detection sensor 61 is what is known as a reflective-type sensor, and detects registration marks, inter-paper marks, and so on formed on the intermediate transfer belt 31 in the manner described later by emitting light toward the surface of the intermediate transfer belt 31 from a light-projecting element and then receiving light that has been reflected off from the surface of the intermediate transfer belt 31 using a light-receiving element; the mark detection sensor 61 then outputs detection signals to the control unit 13. The mark detection sensor 61 thus functions as a "first sensor" according to the invention. Meanwhile, a second mark detection sensor 62 having the same configuration as the first mark detection sensor 61 is supported on the black side of the main body frame 20 (that is, the right-hand side in FIG. 2) slightly downstream from (that is, in FIGS. 1 and 2, on the right-hand side of) the primary transfer location TR1 for black, and as will be described later, detects bias setting marks, registration marks, inter-paper marks, and so on, and outputs detection signals to the control unit 13. The mark detection sensor 62 thus functions as a "second sensor" according to the invention. Note that in this embodiment, the distance between the mark detection sensors 61 and 62 in the movement direction D31 of the intermediate transfer belt 31 is the same value as the distance between the photosensitive drum 21 for yellow and the photosensitive drum 21 for black, or in other words, three times the pitch distance.

The toner images transferred onto the intermediate transfer belt 31 are then transported to a secondary transfer location TR2, as shown in FIG. 1. At this secondary transfer location TR2, a secondary transfer roller 4 is disposed opposite to the driving roller 32 with the intermediate transfer belt 31 therebetween, thus forming a winding nip. The monochromatic or multi-colored toner image held on the intermediate transfer belt 31 is transferred onto the recording medium RM, which is transported along a transport path from a pair of gate rollers 51 and 51, at the secondary transfer location TR2 in which the nip is formed in this manner.

In addition, in this embodiment, a transmissive-type vertical synchronization sensor 63 is disposed slightly upstream from the first tension roller 33, and is capable of detecting a tag portion (not shown) provided in an end portion of the front of the intermediate transfer belt 31. The image formation carried out at the image forming stations 2Y, 2M, 2C, and 2Bk is controlled based on a vertical synchronization signal Vsync outputted when the tag portion is detected by the vertical synchronization sensor 63.

Note that the recording medium RM onto which the toner image has undergone the secondary transfer is fed into a fixing unit (not shown) from the secondary transfer roller 4 along a transport path, where the toner image is fixed onto the recording medium RM by applying heat, pressure, or the like to the single- or multi-colored toner image transferred onto the recording medium RM.

Incidentally, with the image forming apparatus 1 according to this embodiment, the two mark detection sensors 61 and 62 are provided at a distance in the movement direction D31 of the intermediate transfer belt 31, as described earlier. Accordingly, forming an image such as a registration mark, an inter-paper mark, or the like on the intermediate transfer belt 31 and measuring the timing differences between signals outputted when those marks are detected by the mark detection sensors 61 and 62, or in other words, measuring the amount of time that passes between sensors, makes it possible to detect the movement speed of the intermediate transfer belt 31 (that is, the belt speed). However, with the image forming apparatus 1 that has the winding portion 263, the contact region, contact surface area, and so on between the photosensitive drum 21 and the intermediate transfer belt 31 is broader than with a dry-type image forming apparatus, and thus the apparatus is more susceptible to the influence of voltage fluctuation at the primary transfer location (the winding portion 263). This is also due to the belt resistance value fluctuating significantly in accordance with the running time of the apparatus 1, compared to a dry-type image forming apparatus, and due to a wide discrepancy between the belt resistance values prior to and following the replacement of the intermediate transfer belt when the intermediate transfer belt 31 is replaced. In addition, the apparatus is also influenced by image patterns located on the winding portion 263, such as a solid pattern, a fine line pattern, or the like. This voltage fluctuation causes the friction arising at the primary transfer location (the winding portion 263) to change significantly.

Figure 5:
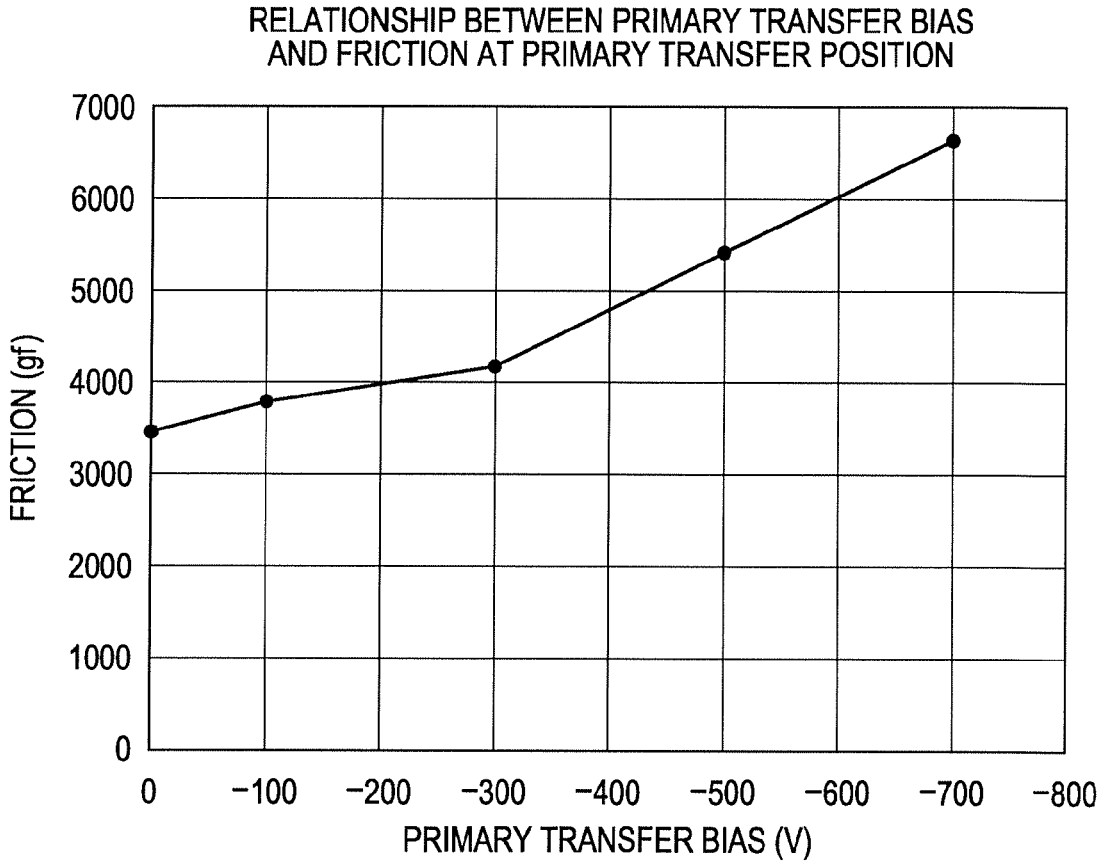
FIG. 5 is a graph illustrating a relationship between a primary transfer bias and friction arising at a primary transfer location.

FIG. 5 is a graph illustrating a relationship between the primary transfer bias and friction arising at the primary transfer location. The inventors of this invention detected the torque of the belt driving motor while applying various different primary transfer biases to the backup roller 261, and found the friction based on those detection results. As a result, as shown in FIG. 5, it was understood that the friction changes depending on the primary transfer bias. In this manner, the liquid developer-type image forming apparatus 1 that has the winding portion 263 includes many sources of fluctuation in the voltage value of the primary transfer bias, and if the friction at the winding portion 263 fluctuates as a result of this fluctuation, the belt speed will change due to the fluctuation in friction; thus, even if the belt speed is measured based on the detection results of the two mark detection sensors 61 and 62, accurate registration adjustment cannot be carried out.

Accordingly, in this embodiment, a primary transfer bias setting process, described hereinafter, is performed and the optimum primary transfer bias voltage values for the image forming stations 2Y, 2M, 2C, and 2Bk are found, and primary transfer biases of those voltage values are applied to the respective backup rollers 261 thereafter.

Figure 6:
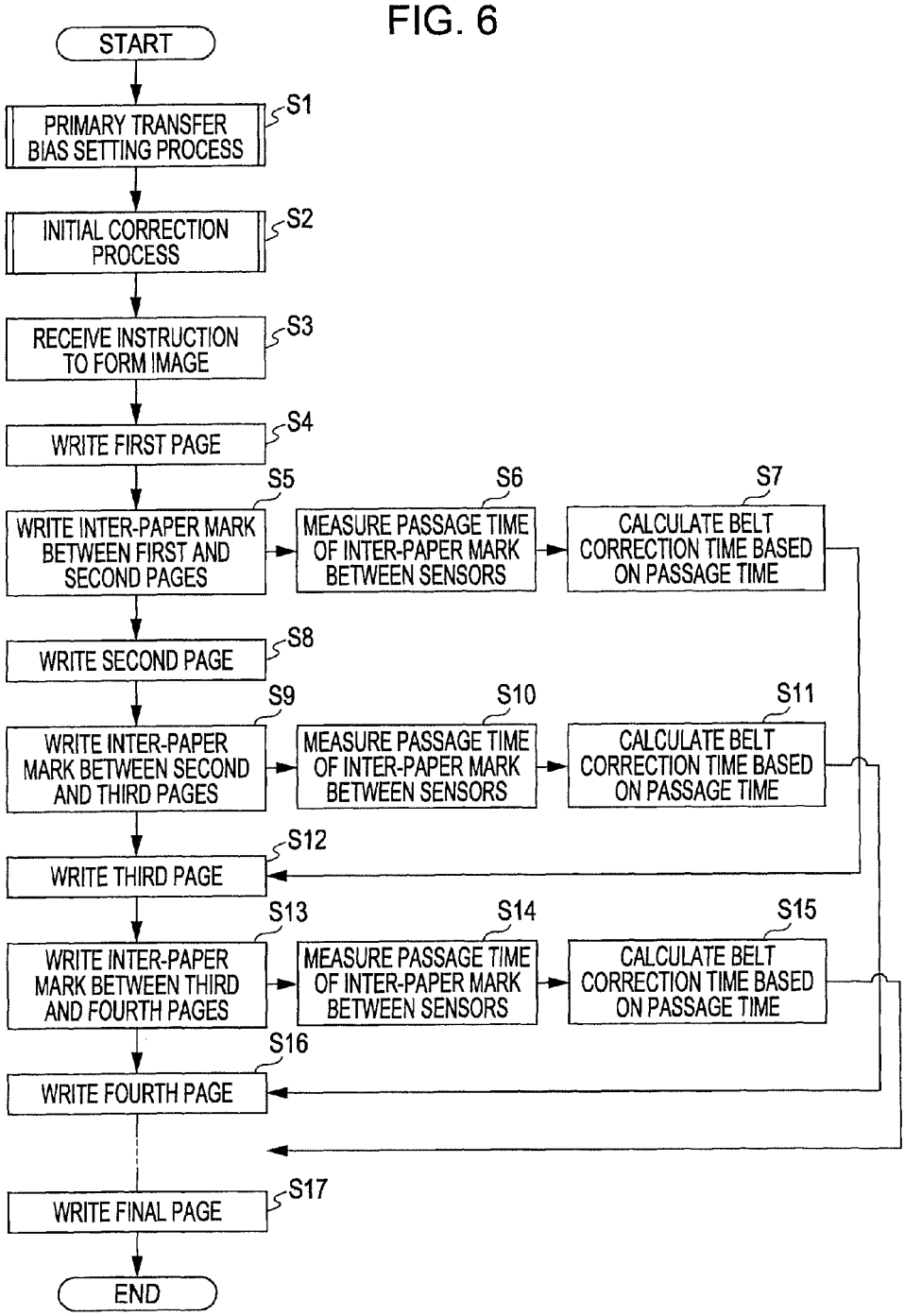
FIG. 6 is a flowchart illustrating basic operations performed by the image forming apparatus illustrated in FIG. 1.
Figure 7:
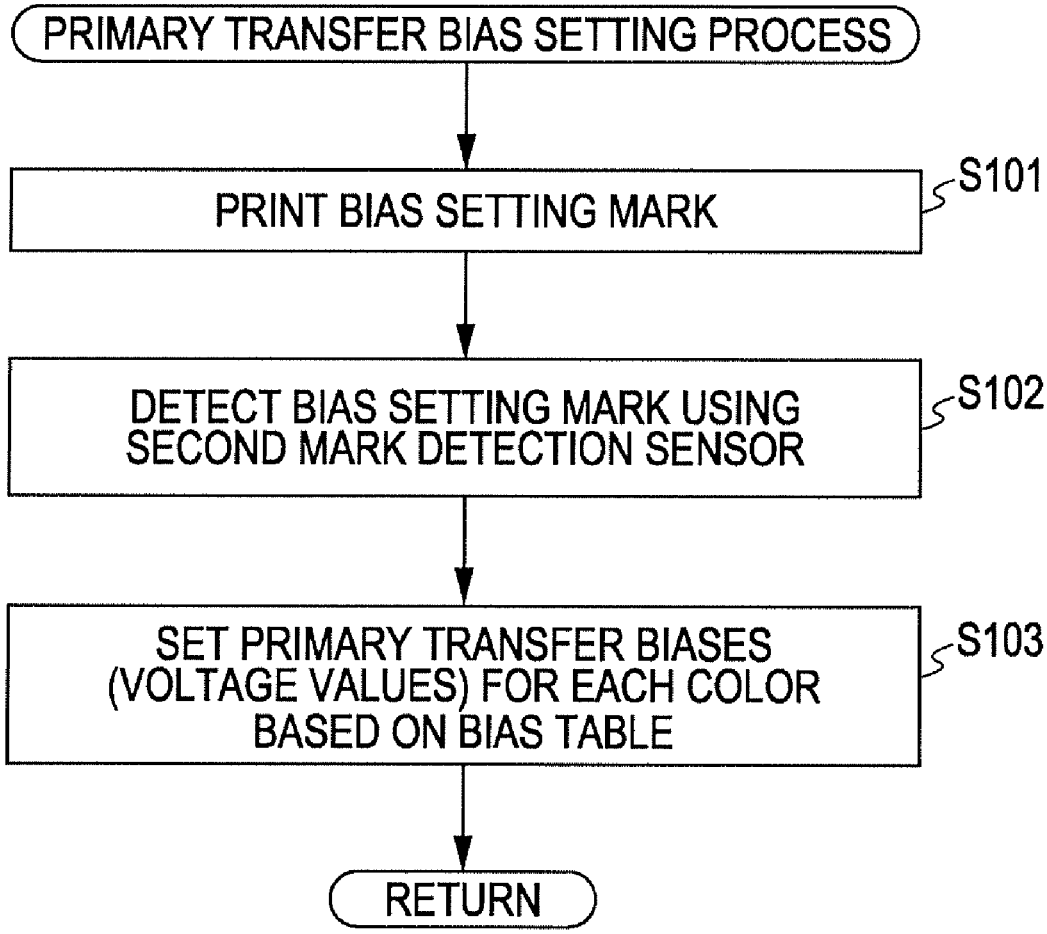
FIG. 7 is a flowchart illustrating a primary transfer bias setting process.
Figure 8:
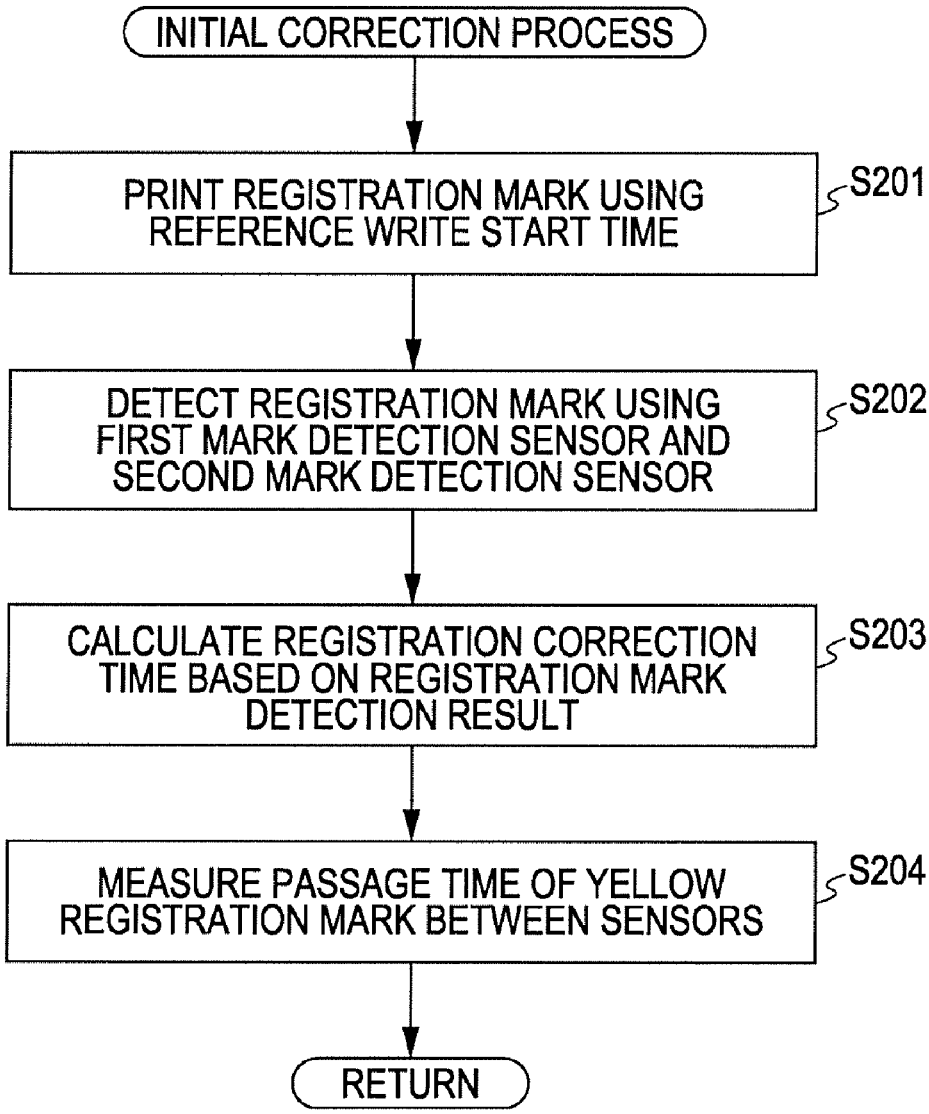
FIG. 8 is a flowchart illustrating an initial adjustment process.

FIG. 6 is a flowchart illustrating basic operations performed by the image forming apparatus illustrated in FIG. 1. Meanwhile, FIG. 7 is a flowchart illustrating the primary transfer bias setting process. Furthermore, FIG. 8 is a flowchart illustrating an initial adjustment process. With the image forming apparatus 1, when bias setting conditions are met, the CPU 131 executes the primary transfer bias setting process (step S1) and the initial adjustment process (step S2) sequentially in accordance with a program stored in advance in the memory 132 of the control unit 13, and as a result, the apparatus 1 enters a state in which it is capable of receiving an image formation instruction from the exterior and forming an image. Note that the "bias setting conditions" include (1) the power to the apparatus being turned on, (2) the intermediate transfer belt 31 being replaced, (3) a photosensitive drum 21 being replaced, and so on. In addition, the internal temperature of the apparatus may be measured using a temperature sensor, and the temperature fluctuating greater than or equal to a set amount may then be included in the "bias setting conditions".

Figure 9:
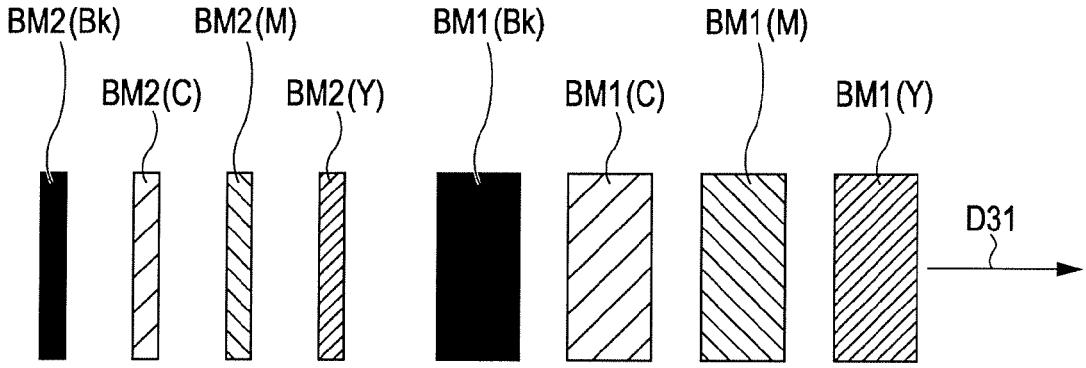
FIG. 9 is a diagram illustrating a primary transfer bias setting process.

As shown in FIG. 7, in the primary transfer bias setting process of step S1, image data indicating a bias setting mark stored in advance in the memory 132 is read out, and the bias setting mark is printed (step S101). In this embodiment, when the vertical synchronization sensor 63 detects the tab portion of the intermediate transfer belt 31 and outputs the vertical synchronization signal Vsync, and after a predetermined amount of time has passed after that signal output, the formation of yellow bias setting marks BM1(Y) and BM2(Y) is commenced at the image forming station 2Y based on the image data within the memory 132. In this embodiment, as shown in FIG. 9, two types of bias setting marks, or BM1(Y) and BM2(Y), whose thicknesses in the movement direction D31 are mutually different, are formed, and this takes into consideration the fact that thicknesses, in the movement direction D31, of the image that passes through the winding portion 263 during the primary transfer differ depending on the image pattern.

As with yellow, the formations of bias setting marks BM1(M), BM1(C), BM1(Bk), BM2(M), BM2(C), BM2(Bk), and so on are commenced at the image forming stations 2M, 2C, and 2Bk as well. Although image data indicating the bias setting mark is stored in advance in the memory 132 in this embodiment, it should be noted that the configuration may be such that the image data is supplied from outside of the apparatus. In addition, although the number, position, and so on of the bias setting marks may be set as desired, a patch image, for example, used in the processing control may be employed as-is for the bias setting marks BM1(Y), BM1(M), BM1(C), and BM1(Bk).

The two types of bias setting marks whose thicknesses are mutually different in this manner are then transferred onto the intermediate transfer belt 31 from the photosensitive drum 21 corresponding to each color, and the darknesses of the bias setting marks are detected when the bias setting marks pass the second mark detection sensor 62; these detection signals are then outputted to the control unit 13 (step S102). A bias table (not shown), in which relationships between the darknesses of the bias setting marks and the voltage values of the primary transfer biases are held, is stored in advance in the memory 132 of the control unit 13, and upon receiving the aforementioned detection signals, the control unit 13 sets the primary transfer bias voltage value for each color based on the aforementioned detection results and bias table so that the darknesses of the thick bias setting marks BM1(Y), BM1(M), BM1(C), and BM1(Bk) and the darknesses of the thin bias setting marks BM2(Y), BM2(M), BM2(C), and BM2(Bk) are appropriate values (step S103).

The initial adjustment process is executed after the primary transfer bias setting process ends. In the initial adjustment process, the following reference write start times stored in advance in the memory 132 are read out:

Tdely_std_Y: reference write start time (yellow)

Tdely_std_M: reference write start time (magenta)

Tdely_std_C: reference write start time (cyan)

Tdely_std_Bk: reference write start time (black)

The times from the vertical synchronization signal Vsync to the start of exposures at the image forming stations 2Y, 2M, 2C, and 2Bk, or in other words, write start times Tdely_Y, Tdely_M, Tdely_C, and Tdely_Bk are respectively set to the reference write start times Tdely_std_Y, Tdely_std_M, Tdely_std_C, and Tdely_std_Bk, and the registration marks are printed (step S201). In this embodiment, image data indicating the registration marks is stored in the memory 132 in advance, and when the vertical synchronization sensor 63 has detected the tab portion on the intermediate transfer belt 31 and outputted the vertical synchronization signal Vsync, and the reference write start time (yellow) Tdely_std_Y has passed following that signal output, the formation of the yellow registration marks MK1(Y), MK2(Y), and so on at the image forming station 2Y is commenced based on registration mark image data within the memory 132. After that, when the reference write start time (magenta) Tdely_std_M, the reference write start time (cyan) Tdely_std_C, and the reference write start time (black) Tdely_std_Bk have each passed after the vertical synchronization signal Vsync, the formation of the registration marks MK1(M), MK1(C), MK1(Bk), MK2(M), MK2(C), MK2(Bk), and so on is commenced at the respective image forming stations 2M, 2C, and 2Bk, in the same manner as with yellow. Although image data indicating the registration marks is stored in advance in the memory 132 in this embodiment, it should be noted that the configuration may be such that the image data is supplied from outside of the apparatus. Furthermore, the number, location, and so on of the registration marks may be set as desired.

Figure 10A:
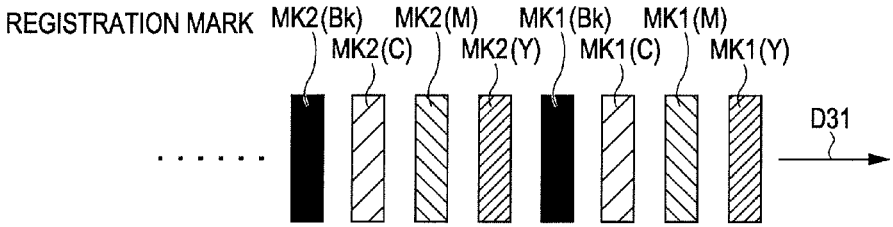
FIGS. 10A, 10B, 10C and 10D are diagrams illustrating operations performed by the image forming apparatus illustrated in FIG. 1.
Figure 10B:
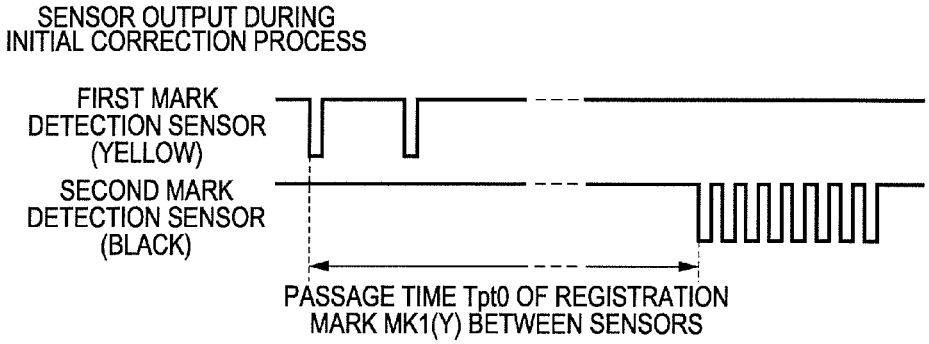

Of the registration marks formed in this manner, the yellow registration marks MK1(Y), MK2(Y), and so on are transferred onto the intermediate transfer belt 31, and then pass the first mark detection sensor 61. At the time of this passage, a detection signal is outputted as shown in, for example, FIG. 10B. Meanwhile, the registration marks MK1(M), MK1(C), MK1(Bk), MK2(M), MK2(C), MK2(Bk), and so on of the other colors are each transferred onto the intermediate transfer belt 31, and are transported toward the secondary transfer location TR2 along with the registration marks MK1(Y), MK2(Y), and so on; these marks pass the second mark detection sensor 62, and detection signals are outputted at the timings of the respective passages, as indicated in FIG. 10B. The control unit 13 then calculates a registration adjustment time based on the signals, of these signals, that are outputted by the second mark detection sensor 62 (step S203):

Tdely_adj_R_M: registration adjustment time (magenta)

Tdely_adj_R_C: registration adjustment time (cyan)

Tdely_adj_R_Bk: registration adjustment time (black)

Then, based on the following equations, the control unit 13 calculates the write start time (yellow) Tdely_Y, the write start time (magenta) Tdely_M, the write start time (cyan) Tdely_C, and the write start time (black) Tdely_Bk:

$$Tdely_Y = Tdely_std_Y$$

$$Tdely_M = Tdely_std_M + Tdely_adj_R_M$$

$$Tdely_C = Tdely_std_C + Tdely_adj_R_C$$

$$Tdely_Bk = Tdely_std_Bk + Tdely_adj_R_Bk$$

By adding the registration adjustment time based on the results of detecting the registration marks in this manner, the toner images of the other colors can be positioned with respect to the yellow toner image, thus making it possible to favorably correct registration shift. Note that in this embodiment, yellow is used as the reference color, and the registration adjustment is carried out by adjusting the image formation timing of the other colors; thus the registration adjustment time is not calculated for yellow. Of course, the registration adjustment time (yellow) is found when another color is used as the reference, when a different reference is set, and so on. With respect to the method for calculating the registration adjustment time, various techniques have been used in the past, and thus descriptions thereof will be omitted here.

Meanwhile, the control unit 13 calculates an inter-sensor passage time Tpt0 based on signals outputted when the registration mark MK1(Y) passes the mark detection sensors 61 and 62, and stores that inter-sensor passage time in the memory 132 (step S204). Although the inter-sensor passage time is found only for the registration mark MK1(Y) in this embodiment, it should be noted that, for example, inter-sensor passage times may be found for each of multiple yellow registration marks, and the average value thereof may then be stored in the memory 132 as the inter-sensor passage time Tpt0; the same also applies to the inter-paper marks that will be described later. In this manner, the inter-sensor passage time Tpt0 during the initial adjustment process is found, and the inter-sensor passage time Tpt0 is taken as an example of information related to the movement speed of the intermediate transfer belt 31 immediately after the power of the apparatus has been turned on.

In this embodiment, the mark detection sensor 62 is provided so as to function both as a registration sensor that detects darkness information for performing registration adjustment and a belt position sensor that detects the inter-sensor passage time for measuring the belt speed, but it should be noted that the registration sensor may be provided independently. For example, the registration sensor may be provided opposite to the driving roller 32 sandwiching the intermediate transfer belt 31 therebetween, upstream from the winding nip in the movement direction D31 of the intermediate transfer belt 31.

When the initial adjustment process (step S2) is completed, the control unit 13 stops the movement of the intermediate transfer belt 31 and stands by for an image formation instruction from the external device. Then, as shown in FIG. 6, when that instruction has been received (step S3), the control unit 13 controls the various elements of the apparatus in the following manner (steps S4 to S17), and prints an image corresponding to the instruction onto the recording medium RM, which is, for example, standard paper.

Having received the image formation instruction, the control unit 13 starts the movement of the intermediate transfer belt 31. Then, when the tab portion of the intermediate transfer belt 31 passes the vertical synchronization sensor 63 while the belt is moving and the vertical synchronization signal Vsync is outputted, the first page is written using the aforementioned write start times Tdely_Y, Tdely_M, Tdely_C, and Tdely_Bk (step S4). In other words, with respect to yellow, when the write start time Tdely_Y has passed from the vertical synchronization signal Vsync, latent image formation is commenced by the exposure head 23 at the image forming station 2Y, and the latent image formed by the exposure head 23 is then developed by the corresponding developing unit 24, thus forming a yellow image; this image then undergoes primary transfer onto the intermediate transfer belt 31 at the primary transfer location TR1 of the image forming station 2Y. In addition, when the write start time Tdely_M (>Tdely_Y) has passed from the vertical synchronization signal Vsync, latent image formation is commenced by the exposure head 23 at the following image forming station 2M, and the latent image formed by the exposure head 23 is then developed by the corresponding developing unit 24, thus forming a magenta image; this image then undergoes primary transfer onto the intermediate transfer belt 31 at the primary transfer location TR1 of the image forming station 2M. Through this, the magenta image is superimposed upon the yellow image. Furthermore, a cyan image and a black image are formed in the same manner as in the aforementioned magenta image forming station 2M each time the write start times Tdely_C and Tdely_Bk, respectively, have passed from the vertical synchronization signal Vsync, and those images then undergo primary transfer onto the intermediate transfer belt 31. A color image in which toner images of four colors are superimposed is thus formed upon the first page. After this, the color image is transferred onto the recording medium RM at the secondary transfer location TR2, and the image is then fixed by the fixing unit. Printing is performed on the recording medium RM in this manner.

Figure 10C:
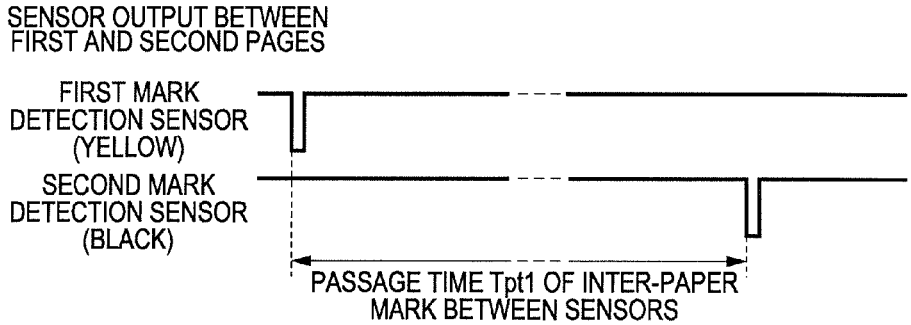

Next, writing of the second page is executed after a predetermined amount of time has passed following the completion of the writing of the first page. This "predetermined amount of time" is for setting what is known as the paper interval, and in the past, the image forming apparatus 1 has generally not executed writing operations during this predetermined amount of time. However, in this embodiment, the inter-paper mark, for detecting fluctuations in the movement speed of the intermediate transfer belt 31, is created using this paper interval. In other words, the formation of a yellow inter-paper mark (not shown) is commenced at the image forming station 2Y based on inter-paper mark image data within the memory 132 during the period between when the writing of the first page is completed and when the writing of the second page commences (step S5). In this embodiment, only a single inter-paper mark, which has the same shape as the registration marks, is formed; this inter-paper mark is transferred onto the intermediate transfer belt 31 and then passes the first and second mark detection sensors 61 and 62 in that order. At the time of this passage, two detection signals are outputted as shown in, for example, FIG. 10C. The control unit 13 then measures an inter-sensor passage time Tpt1 of the inter-paper mark based on those detection signals (step S6) and stores that time in the memory 132, and furthermore compares that inter-sensor passage time Tpt1 to the inter-sensor passage time Tpt0 stored in the memory 132. This takes into consideration the fact that when the temperature within the apparatus fluctuates from when the initial adjustment process is performed to when the writing of the first page is complete, the belt speed also fluctuates in accordance with that temperature change, and accordingly, based on the following equations, the control unit 13 calculates a belt adjustment time (magenta) Tdely_adj_B_M, a belt adjustment time (cyan) Tdely_adj_B_C, and a belt adjustment time (black) Tdely_adj_B_Bk (step S7), and stores those belt adjustment times in the memory 132:

$$Tdely_adj_B_M=(Tpt1-Tpt0)/3$$

$$Tdely_adj_B_C=(Tpt1-Tpt0)/3$$

$$Tdely_adj_B_Bk=(Tpt1-Tpt0)/3$$

Although the four photosensitive drums 21 are, as described above, arranged parallel to the movement direction D31 of the intermediate transfer belt 31 at the same pitch distance in the present embodiment, and thus the fluctuation amount of the inter-sensor passage time (Tpt1−Tpt0) is divided by 3, it should be noted that in the case where the drum intervals differ, the belt adjustment time (magenta) Tdely_adj_B_M, the belt adjustment time (cyan) Tdely_adj_B_C, and the belt adjustment time (black) Tdely_adj_B_Bk can each be calculated in accordance with those drum intervals. The same applies to the second page on.

Figure 10D:
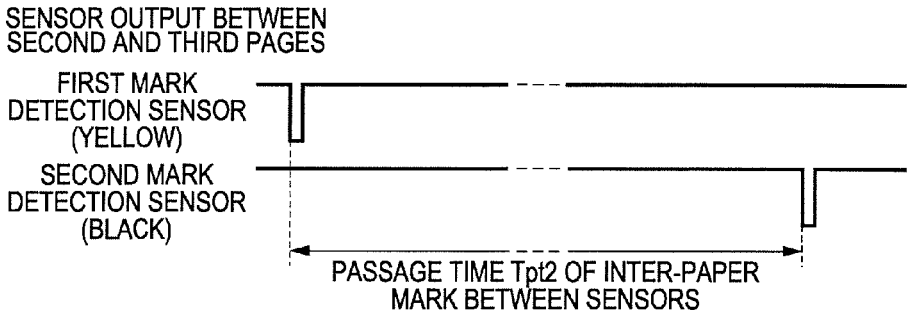

In this manner, the writing of the second page (step S8) is commenced between the writing of the inter-paper mark (step S5) and the calculation of the belt adjustment times (step S7). Note that this writing operation is carried out in the same manner as with the first page. The writing of the third page is then executed after a predetermined amount of time following the completion of the writing of the second page, but during that time, the formation of the inter-paper mark (step S9), the primary transfer, and the detection performed by the sensors 61 and 62 are carried out in the same manner as with the first and second pages. Through this, each time the inter-paper mark passes the sensors 61 and 62, a detection signal is outputted to the control unit 13, as shown in, for example, FIG. 10D. The control unit 13 then measures an inter-sensor passage time Tpt2 of the inter-paper mark based on those detection signals (step S10) and furthermore compares that inter-sensor passage time Tpt2 to the previous inter-sensor passage time Tpt1 stored in the memory 132. This takes into consideration the fact that when the temperature within the apparatus fluctuates from when the writing of the first page is commenced to when the writing of the second page is complete, the belt speed also fluctuates in accordance with that temperature change, and accordingly, based on the following equations, the control unit 13 calculates a belt adjustment time (magenta) Tdely_adj_B_M, a belt adjustment time (cyan) Tdely_adj_B_C, and a belt adjustment time (black) Tdely_adj_B_Bk (step S21), and updates the belt adjustment time (magenta) Tdely_adj_B_M, the belt adjustment time (cyan) Tdely_adj_B_C, and the belt adjustment time (black) Tdely_adj_B_Bk stored in the memory 132:

$$Tdely_adj_B_M=(Tpt2-Tpt1)/3$$

$$Tdely_adj_B_C=(Tpt2-Tpt1)/3$$

$$Tdely_adj_B_Bk=(Tpt2-Tpt1)/3$$

In this manner, the writing of the third page (step S12) is commenced between the writing of the inter-paper mark (step S9) and the calculation of the belt adjustment times (step S11). In this embodiment, although step S11 has not yet been completed at the point in time where the writing of the third page has commenced, the belt adjustment time (magenta) Tdely_adj_B_M, the belt adjustment time (cyan) Tdely_adj_B_C, and the belt adjustment time (black) Tdely_adj_B_Bk have already been found through the execution of step S7, and have been stored in the memory 132. Accordingly, the control unit 13 reads out the belt adjustment time (magenta) Tdely_adj_B_M, the belt adjustment time (cyan) Tdely_adj_B_C, and the belt adjustment time (black) Tdely_adj_B_Bk from the memory 132, and, based on the following equations, the control unit 13 calculates the write start time (yellow) Tdely_Y, the write start time (magenta) Tdely_M, the write start time (cyan) Tdely_C, and the write start time (black) Tdely_Bk:

$$Tdely_Y=Tdely_std_Y$$

$$Tdely_M=Tdely_std_M+Tdely_adj_R_M+Tdely_adj_B_M$$

$$Tdely_C=Tdely_std_C+Tdely_adj_R_C+Tdely_adj_B_C$$

$$Tdely_Bk=Tdely_std_Bk+Tdely_adj_R_Bk+Tdely_adj_B_Bk$$

Figure 11A:
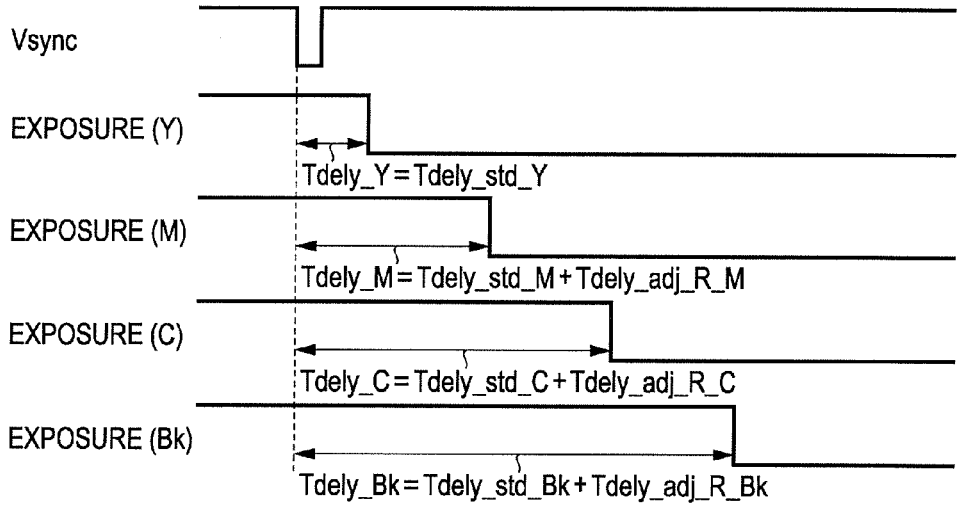
FIGS. 11A and 11B are timing charts illustrating exposure timings during printing.
Figure 11B:
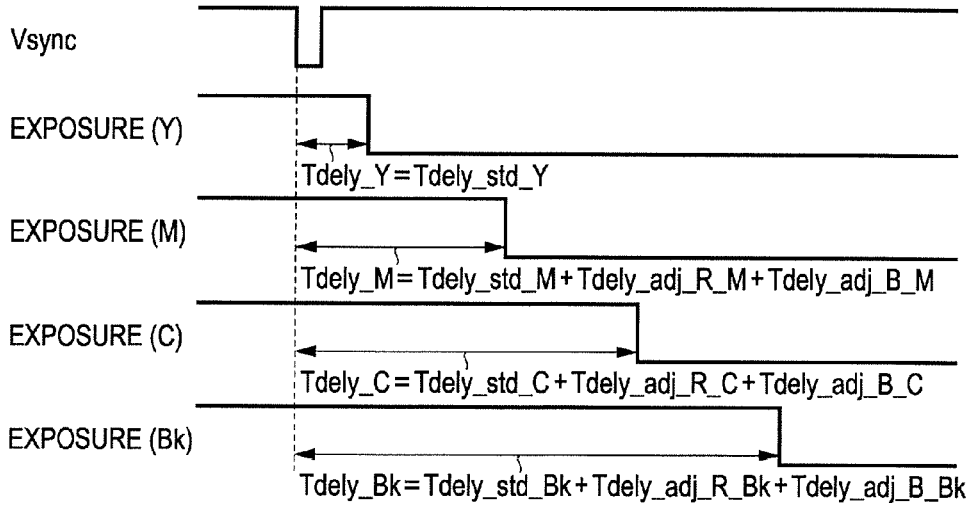

Then, as shown in FIG. 11B, the control unit 13 commences the writing of the third page using the stated write start times Tdely_Y, Tdely_M, Tdely_C, and Tdely_Bk (step S12).

The writing of the fourth page is then executed after a predetermined amount of time following the completion of the writing of the third page, but during that time, the formation of the inter-paper mark (step S13), the primary transfer, and the detection performed by the sensors 61 and 62 are carried out in the same manner as with the previous pages. Then, in the same manner as with steps S10 and S11, the control unit 13 measures the inter-sensor passage time of the inter-paper mark based on those detection signals (step S14), compares that inter-sensor passage time to the previous inter-sensor passage time Tpt2, calculates the belt adjustment time (magenta) Tdely_adj_B_M, the belt adjustment time (cyan) Tdely_adj_B_C, and the belt adjustment time (black) Tdely_adj_B_Bk, and updates the data in the memory 132 (step S15). Through this, the belt adjustment time (magenta) Tdely_adj_B_M, the belt adjustment time (cyan) Tdely_adj_B_C, and the belt adjustment time (black) Tdely_adj_B_Bk are updated to the latest values.

The same processes as those described above are then repeated after the writing of the fourth page (step S16) and up until the execution of the writing of the final page (step S17), and the formation timings of the magenta, cyan, and black latent images are adjusted using the latest belt adjustment time (magenta) Tdely_adj_B_M, belt adjustment time (cyan) Tdely_adj_B_C, and belt adjustment time (black) Tdely_adj_B_Bk stored in the memory 132. Accordingly, the registration shift can be corrected in a favorable manner, and thus superior image quality can be achieved.

As described thus far, according to the first embodiment, at each primary transfer location (winding portion 263), the backup roller 261 makes contact with the photosensitive drum 21 through the intermediate transfer belt 31 and the primary transfer bias of a constant voltage set in the primary transfer bias setting process (step S1) is applied to the backup roller 261. Accordingly, even if the belt resistance value of the intermediate transfer belt 31 fluctuates, the patterns of the images transferred onto the intermediate transfer belt 31 from the photosensitive drum 21 differ, and so on, voltage fluctuation at the transfer locations (winding portions 263) can be suppressed, and as a result, fluctuations in the friction at the primary transfer location TR1, or in other words, at the winding portion 263, can be suppressed, which in turn makes it possible to cyclically move the intermediate transfer belt 31 with superior stability.

Furthermore, because the intermediate transfer belt 31 can be cyclically moved with stability, the relative positions of the toner images of the respective colors can be controlled by adjusting the formation timing of the latent images by the exposure heads 23 based on the detection results from the first and second mark detection sensors 61 and 62; this makes it possible to effectively suppress registration shift and achieve superior image quality as a result.

Figure 12:
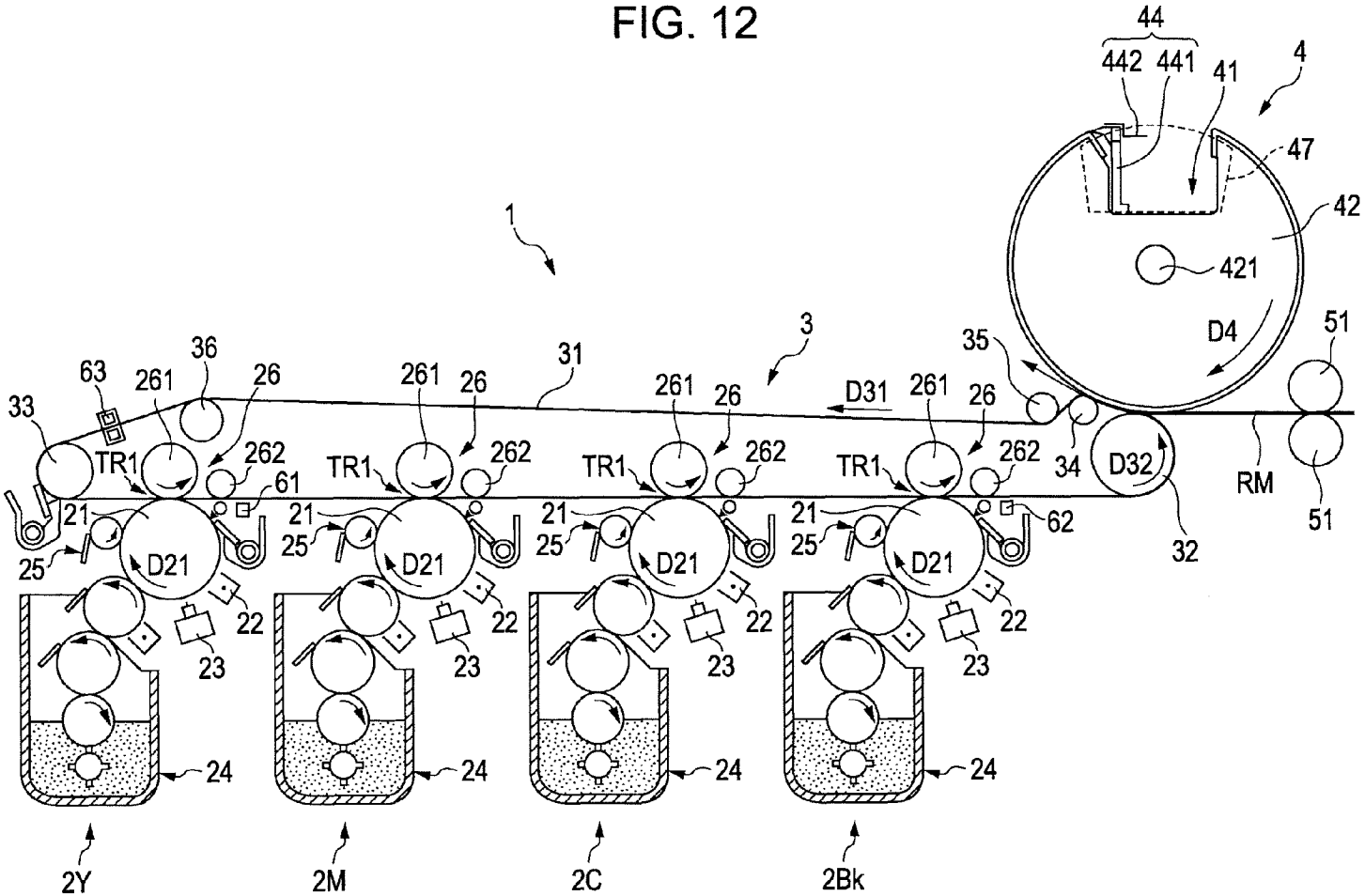
FIG. 12 is a diagram illustrating the overall configuration of a second embodiment of an image forming apparatus according to the invention.

FIG. 12 is a diagram illustrating the overall configuration of a second embodiment of an image forming apparatus according to the invention. The major difference between the second embodiment and the first embodiment (FIG. 1) is in the configuration of the secondary transfer roller, and other configurations are basically the same as those of the first embodiment. Accordingly, descriptions will be given central to that difference, whereas identical or corresponding configurations will be given the same or corresponding reference numerals and detailed descriptions thereof will be omitted.

Figure 13A:
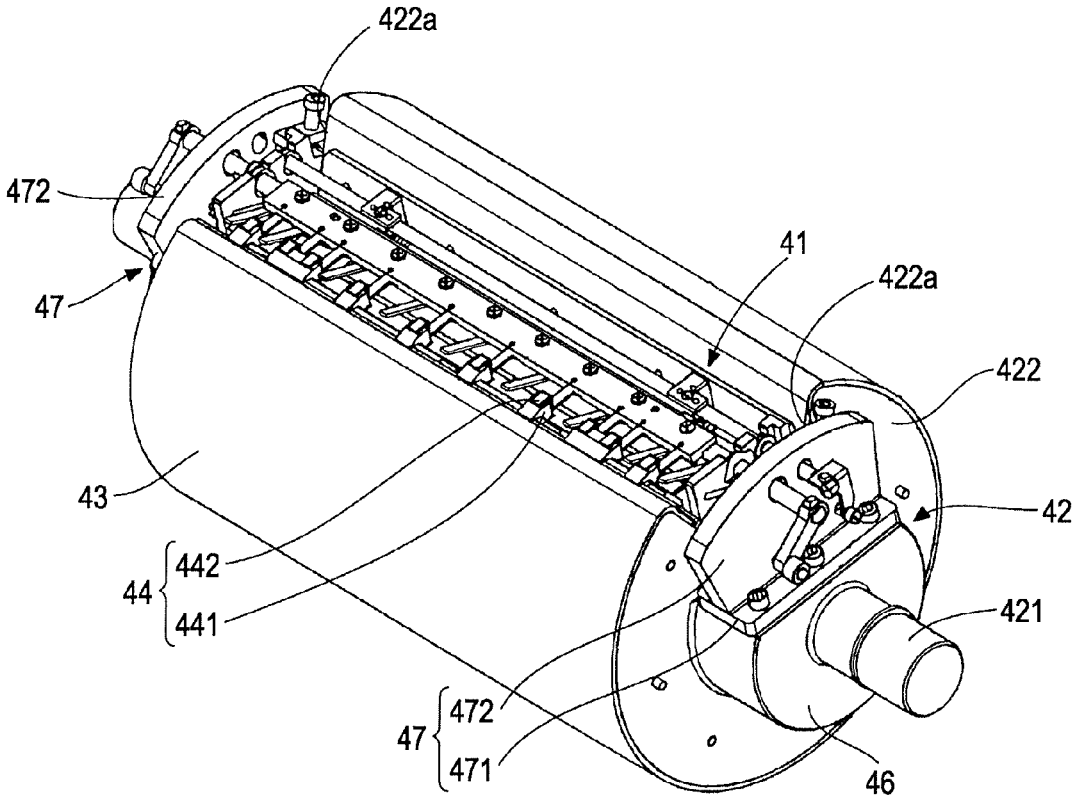
FIGS. 13A and 13B are diagrams illustrating a secondary transfer roller used in the image forming apparatus illustrated in FIG. 12.
Figure 13B:
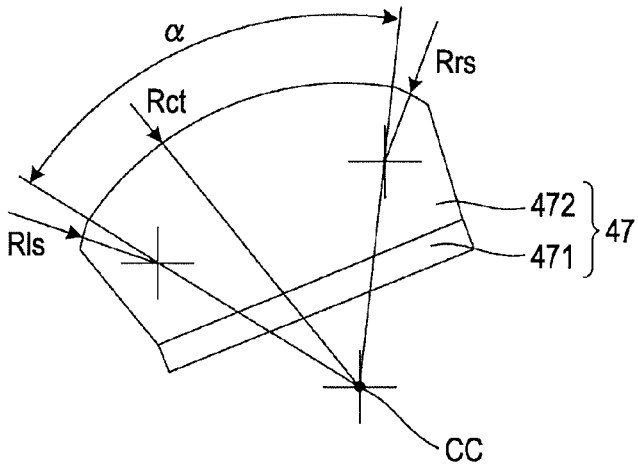
Figures 1, 2, 14A, 14B:
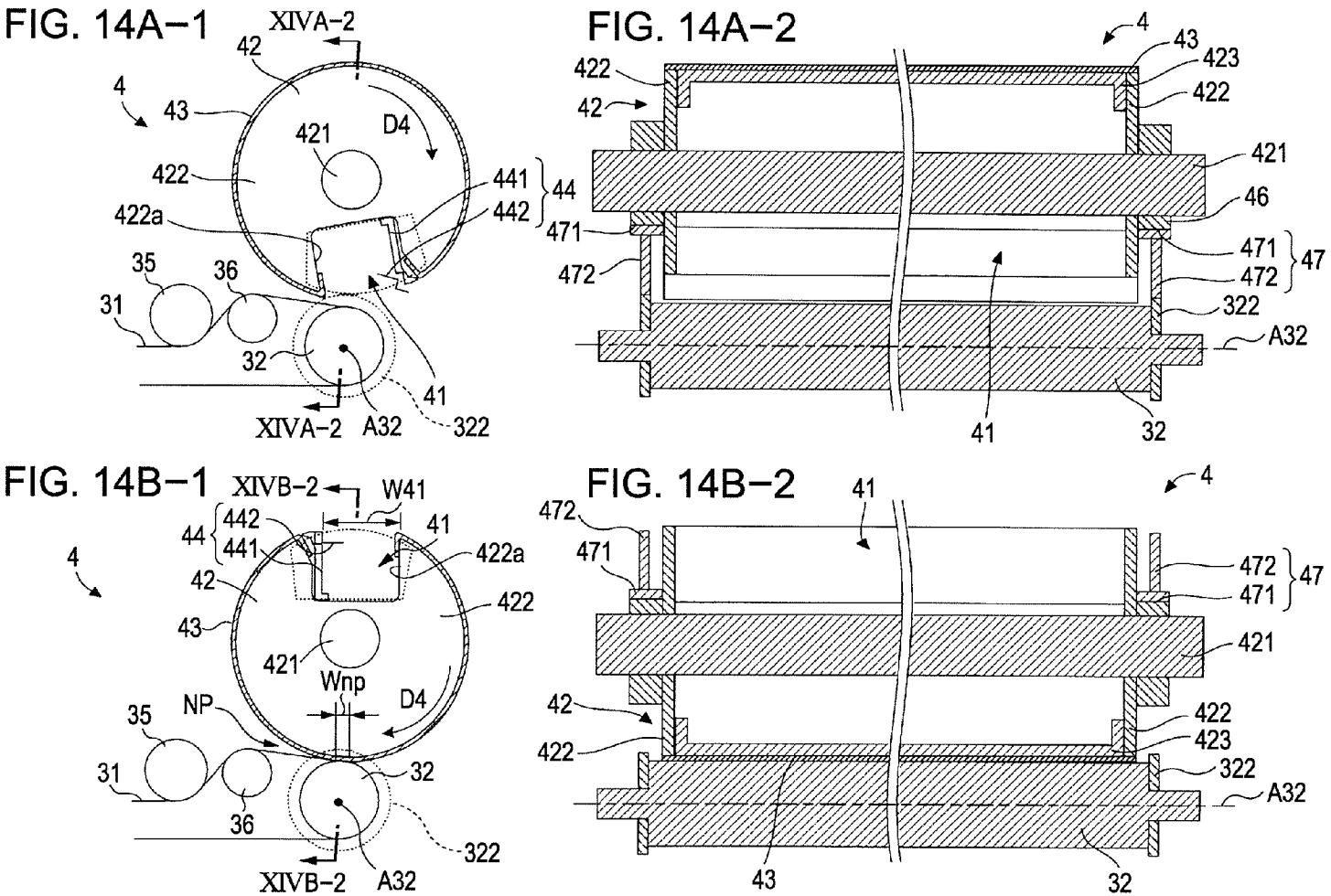

FIGS. 13A and 13B are diagrams illustrating the secondary transfer roller using in the image forming apparatus shown in FIG. 12; FIG. 13A is a perspective view illustrating the overall configuration of the secondary transfer roller, whereas FIG. 13B is a side view illustrating the shape of a contact member. FIGS. 14A-1, 14A-2, 14B-1 and 14B-2, meanwhile, are diagrams illustrating the relationship between the secondary transfer roller, an intermediate transfer belt, and a driving roller, where FIG. 14A-1 is a side view illustrating a state when a concave portion is opposite to the driving roller, FIG. 14A-2 is a cross-section viewing the content shown in FIG. 14A-1 along the XIVA-2-XIVA-2 line, FIG. 14B-1 is a side view illustrating a state in which a nip is formed, and FIG. 14B-2 is a cross-section viewing the content shown in FIG. 14B-1 along the XIVB-2-XIVB-2 line. As illustrated in these diagrams, the secondary transfer roller 4 includes a roller base member 42, in the outer circumferential surface of which a concave portion 41 is provided. As shown in FIG. 14A-1 through FIG. 14B-2, with the roller base member 42, a rotational shaft 421 is disposed parallel or approximately parallel to a rotational axis A32 of a driving roller (belt transport roller) 32 (FIG. 14A-1 through FIG. 14B-2), and side plates 422 and 422 are attached to the respective ends of the rotational shaft 421. To be more specific, the side plates 422 and 422 each have a shape in which a cutout portion 422*a* is provided in a disk-shaped metallic plate, and the cutout portion 422*a* has an approximately rectangular shape, as illustrated in the side views shown in FIG. 14A-1 and FIG. 14B-1. As shown in FIG. 13A, the cutout portions 422*a* and 422*a* are provided relative to the rotational shaft 421 at a distance that is slightly longer than the width of the intermediate transfer belt 31, and are provided opposite to each other. Meanwhile, a metallic plate 423 is disposed so as to span from one side plate 422 to the other side plate 422 across the entire circumference of the edges thereof, and the inside surfaces of the side plates 422 and 422 are affixed to the circumferential edges of the metallic plate 423. Accordingly, the roller base member 42 is formed so as to have an overall drum shape, but to also have the concave portion 41 extending parallel or approximately parallel to the rotational shaft 421 in a portion of its outer circumferential surface.

Meanwhile, an elastic layer 43, configured of rubber, a resin, or the like, is formed upon the outer circumferential surface of the roller base member 42, or in other words, on the surface region of the metallic plate excluding the region corresponding to the inner area of the concave portion 41. As will be described later, the elastic layer 43 opposes the intermediate transfer belt 31 that is wound upon the driving roller 32, thus forming a nip NP.

In addition, a catching portion 44 for catching the recording medium RM is disposed within the concave portion 41. This catching portion 44 includes gripper support members 441 erected from the inner base area of the concave portion 41 toward the outer circumferential surface of the roller base member 42 and gripper members 442 supported so as to be making contact with/separating from the tip areas of corresponding gripper support members 441. Each of the gripper members 442 is connected to a gripper driving unit (not shown). Upon receiving a release (ungrip) instruction from the control unit 13, the gripper driving unit operates so that the tip areas of the gripper members 442 separate from the tip areas of the gripper support members 441, thus preparing to catch the recording medium RM, release a caught recording medium RM, and so on. On the other hand, upon receiving a grip instruction from the control unit 13, the gripper driving unit operates so that the tip areas of the gripper members 442 move to the tip areas of the gripper support members 441, thus catching the recording medium RM. Note that the configuration of the catching portion 44 is not intended to be limited to this embodiment, and, for example, a known past catching mechanism such as that disclosed in JP-A-2000-238400 may be employed as well.

Support members 46 and 46 are attached to the outside surfaces of the side plates 422 at both ends of the rotational shaft 421, and are capable of rotating integrally with the roller base member 42. Furthermore, planar regions 461 are formed on respective support members 46 and 46 in correspondence with the concave portion 41. Transfer roller-side contact members 47 are attached to the respective planar regions 461 and 461. In each contact member 47, a base section 471 is attached to the support member 46, and a contact section 472 extends from the base section 471 in the normal line direction of the planar region 461; the tip area of the contact section 472 extends to the vicinity of the side end of the opening of the concave portion 41. In other words, as shown in FIG. 13A, if the roller base member 42 is viewed from the end of the rotational shaft 421, the contact members 47 are disposed so as to cover the concave portion 41.

Meanwhile, as shown in FIG. 13B, the tip area of each contact section 472 is formed as a curve so that the curvature Rct of the central portion thereof is greater than the curvatures Rrs and Rls on both sides thereof. For example, in this embodiment, the outer diameter of the roller base member 42, including the elastic layer 43, is set to 191 mm, whereas the curvature Rct is set to 88.2 mm and the curvatures Rrs and Rls of the sides are set to 22.4 mm. Note that the curvature center CC at the central portion of the contact section 472 is located at the rotational axis of the roller base member 42, or in other words, at the center axis of the rotational shaft 421, and the angular range $\alpha$ of the central portion is set to 63°, corresponding to the range of the opening of the concave portion 41. Accordingly, as will be described later, when the secondary transfer roller 4 rotates, the concave portion 41 opposes the intermediate transfer belt 31 wound upon the driving roller 32 across the angular range $\alpha$. In addition, the length of the opening (opening width) W41 of the concave portion 41 in a rotational direction D4 of the roller base member 42 is:

$$191\times\pi\times(63/360)\approx105 \text{ mm}$$

Meanwhile, the elastic layer 43 forms the nip NP opposite to the stated intermediate transfer belt 31 as described hereinafter with the remaining angular range, and the length of the elastic layer 43 in the rotational direction D4 of the roller base member 42 is set to:

$$191\times\pi\times\{(360-63)/360\}\approx495 \text{ mm}$$

Note that in this embodiment, the length of the nip NP in the rotational direction D4 of the roller base member 42 (the nip width) Wnp is approximately 11 mm, and thus the following relationship is established:

(opening width *W*41 of concave portion 41)>(nip width *Wnp* of nip *NP*)

The secondary transfer roller 4 configured in this manner is disposed so that the rotational shaft 421 is parallel or approximately parallel to the rotational axis A32 of the driving roller 32, and is biased toward the driving roller 32 by a biasing unit (not shown). Accordingly, in the remaining angular range aside from the angular range $\alpha$(an angular range of) 297°, the elastic layer 43 is pushed against the intermediate transfer belt 31 that is wound upon the driving roller 32, thus forming the nip NP, as shown in FIG. 14B-1 and FIG. 14B-2. In addition, in this embodiment, ring-shaped contact members 322 are attached to both sides of a rotational shaft 321 of the driving roller 32, and the outer diameters of those members are set so as to be greater than the value {(thickness of intermediate transfer belt 31)×2+(outer diameter of driving roller 32)}. Accordingly, in the angular range $\alpha$, the central portions of the transfer roller-side contact sections 472 make contact with the driving roller-side contact members 322, and the roller base member 42 and elastic layer 43 are separated from the intermediate transfer belt 31, as shown in FIG. 14A-1 and FIG. 14A-2. Accordingly, in this embodiment, the transfer roller-side contact sections 472 make contact with the driving roller 32 via the driving roller-side contact members 322; however, the configuration may be such that the transfer roller-side contact sections 472 make direct contact with the driving roller 32.

A transfer roller driving motor (not shown) is mechanically connected to the rotational shaft 421 of the secondary transfer roller 4. Furthermore, in this embodiment, a driver (not shown) for driving the transfer roller driving motor is provided; this driver drives the motor in response to instructions supplied by the control unit 13, thus rotationally driving the secondary transfer roller 4 in the clockwise direction illustrated in FIG. 12 and in the with-direction D4 relative to the driving roller 32.

The image forming apparatus 1 configured in this manner also executes the processes illustrated in FIGS. 6 through 8 in order to stabilize the belt speed and suppress registration shift, as in the first embodiment; however, during these processes, the secondary transfer roller 4 operates in the following manner. That is, with the image forming apparatus 1 shown in FIG. 12, when the concave portion 41 provided in the secondary transfer roller 4 is opposed to the intermediate transfer belt 31 wound upon the driving roller 32 (FIG. 14A-1 and FIG. 14A-2), the outer circumferential surface of the secondary transfer roller 4 (the elastic layer 43) separates from the surface of the intermediate transfer belt 31. Accordingly, in the second embodiment, while the primary transfer bias setting process (step S1) and the initial adjustment process (step S2) are being performed, the control unit 13 controls the rotational position of the secondary transfer roller 4 and stops the secondary transfer roller 4 in a state in which the concave portion 41 is opposed to the intermediate transfer belt 31. Through this, the bias setting marks, the registration marks, and so on formed upon the intermediate transfer belt 31 can be effectively prevented from adhering to the secondary transfer roller 4. In addition, while it is necessary to rotate the secondary transfer roller 4 in order to receive the image formation instruction and carry out the printing process, when the inter-paper mark passes the secondary transfer location TR2, the rotation of the secondary transfer roller 4 is controlled so that the concave portion 41 opposes the intermediate transfer belt 31. Accordingly, the inter-paper mark can be effectively prevented from adhering to the secondary transfer roller 4.

Thus in the second embodiment, a primary transfer bias of a constant voltage set in the primary transfer bias setting process (step S1) is applied to the backup roller 261, in the same manner as in the first embodiment. Accordingly, fluctuations in the friction at the primary transfer location TR1, or in other words, at the winding portion 263 can be effectively suppressed, which not only makes it possible to cyclically move the intermediate transfer belt 31 with superior stability, but also effectively prevents bias setting marks BM, registration marks MK, inter-paper marks, and so on from adhering to the secondary transfer roller 4, which in turn makes it possible to prevent the recording medium RM from being soiled when passing the secondary transfer location TR2.

Note that the invention is not limited to the aforementioned embodiments, and various modifications are possible in addition to the content described above without departing from the spirit of the invention. For example, the locations at which the mark detection sensors 61 and 62 are disposed in the aforementioned embodiments are not limited to those embodiments, and any locations in which the "registration marks" and "inter-paper marks" described in the embodiments can be detected may be employed as long as the locations are different from each other.

In addition, in the aforementioned embodiment, the mark detection sensor 62 functions as a registration sensor, but the mark detection sensor 62 may be used only for measuring the inter-sensor passage time, and a dedicated registration sensor may be provided separately.

In addition, although inter-paper marks are formed between all of the pieces of paper and the registration adjustment is carried out based on detection signals for those inter-paper marks in the aforementioned embodiment, the execution frequency thereof can be set as desired, and the configuration may be such that, for example, the registration adjustment is carried out every time when the operating time of the image forming apparatus 1, the number of printed pages, or the like reaches a certain value.

In addition, although the invention is applied in the image forming apparatus 1 having four photosensitive drums 21 in the aforementioned embodiment, the application target is not limited thereto, and the invention can be applied to all types of liquid developer-type image forming apparatuses that have winding portions, and to image forming methods that form images using such apparatuses.

The entire disclosure of Japanese Patent Application No: 2009-180367, filed Aug. 3, 2009 is expressly incorporated by reference herein.

What is claimed is:

1. An image forming apparatus comprising:

a first latent image bearing member that is formed a first latent image;

a first developing unit that forms an image on the first latent image bearing member by developing the first latent image formed on the first latent image bearing member using a first liquid developing agent having toner and a carrier liquid;

a second latent image bearing member, disposed in a different position from that of the first latent image bearing member, that is formed a second latent image;

a second developing unit that forms an image on the second latent image bearing member by developing the second latent image formed on the second latent image bearing member using a second liquid developing agent;

an image bearing belt that moves cyclically while forming a first winding portion by being wound upon the first latent image bearing member and a second winding portion by being wound upon the second latent image bearing member, and onto which the image developed by the first developing unit and the image developed by the second developing unit are transferred;

a first transfer member that makes contact with the first latent image bearing member through the image bearing belt at the first winding portion and that transfers the image developed by the first developing unit onto the image bearing belt;

a second transfer member that makes contact with the second latent image bearing member through the image bearing belt at the second winding portion and that transfers the image developed by the second developing unit onto the image bearing belt;

a transfer bias application unit that applies a transfer bias of a constant voltage to the first transfer member and a transfer bias of a constant voltage to the second transfer member;

a first sensor that detects a position of the image bearing belt; and a second sensor, disposed in a different position from that of the first sensor, that detects a position of the image bearing belt.

2. The image forming apparatus according to claim 1, wherein the first sensor is disposed in a location where the first sensor detects the image transferred onto the image bearing belt from the first latent image bearing member;

the second sensor is disposed in a location where the second sensor detects the image transferred onto the image bearing belt from the first latent image bearing member and that has passed the second winding portion; and the apparatus further comprises:

an adjustment unit that adjusts the relative position on the image bearing belt of the image transferred onto the image bearing belt from the first latent image bearing member and the image transferred onto the image bearing belt from the second latent image bearing member based on a detection result from the first sensor and a detection result from the second sensor.

3. An image forming apparatus comprising:

a latent image bearing member that is formed a latent image;

a developing unit that forms an image on the latent image bearing member by developing the latent image formed on the latent image bearing member using a liquid developing agent having toner and a carrier liquid;

an image bearing belt that moves cyclically while forming a winding portion by being wound upon the latent image bearing member, and onto which the image developed by the developing unit is transferred;

a transfer member that makes contact with the latent image bearing member through the image bearing belt at the winding portion and that transfers the image developed by the developing unit onto the image bearing belt;

a transfer bias application unit that applies a transfer bias of a constant voltage to the transfer member;

a first sensor that detects a position of the image bearing belt; and a second sensor, disposed in a different position from that of the first sensor, that detects a position of the image bearing belt.

4. An image forming method comprising:

forming an image on a latent image bearing member by developing a latent image formed on the latent image bearing member using a liquid developing agent having toner and a carrier liquid;

transferring the image onto an image bearing belt that cyclically moves while forming a winding portion by being wound upon the latent image bearing member;

detecting positions of the image bearing belt using a first sensor and a second sensor disposed in a different position from that of the first sensor; and adjusting a formation position of the latent image based on the results of the detection, wherein at the winding portion, a transfer member makes contact with the latent image bearing member through the image bearing belt, and a transfer bias of a constant voltage is applied to the transfer member.

* * * * *